US007687748B2

(12) United States Patent
Gagas

(10) Patent No.: US 7,687,748 B2
(45) Date of Patent: Mar. 30, 2010

(54) INDUCTION COOK TOP SYSTEM WITH INTEGRATED VENTILATOR

(75) Inventor: John M. Gagas, Milwaukee, WI (US)

(73) Assignee: Western Industries, Inc., Watertown, WI (US)

( * ) Notice: Subject to any disclaimer, the term of this patent is extended or adjusted under 35 U.S.C. 154(b) by 509 days.

(21) Appl. No.: 11/194,867

(22) Filed: Aug. 1, 2005

(65) Prior Publication Data

US 2007/0023420 A1 Feb. 1, 2007

(51) Int. Cl.
*H05B 6/12* (2006.01)
*F23C 15/32* (2006.01)

(52) U.S. Cl. ..... 219/623; 126/21 A

(58) Field of Classification Search ..... 219/623, 219/621, 620, 757, 632; 126/21; 361/381
See application file for complete search history.

(56) References Cited

U.S. PATENT DOCUMENTS 3,710,062 A * 1/1973 Peters, Jr. ..... 219/627
3,786,219 A * 1/1974 Kornrumpf et al. ..... 219/626
3,797,375 A 3/1974 Cerola
3,876,131 A 4/1975 Tolaas
4,013,859 A 3/1977 Peters, Jr.
4,114,009 A 9/1978 Kiuchi et al.
4,149,217 A 4/1979 Tucker
4,151,387 A * 4/1979 Peters, Jr. ..... 219/626
4,169,222 A 9/1979 Tucker
4,191,875 A 3/1980 Cunningham
4,206,336 A 6/1980 Cunningham
4,260,060 A 4/1981 Faller
4,308,443 A 12/1981 Tucker et al.
4,396,818 A 8/1983 Kominami et al.
4,431,892 A * 2/1984 White ..... 219/623
4,446,350 A 5/1984 Mizukawa et al.
4,446,849 A 5/1984 McFarland
4,447,691 A 5/1984 Mizukawa et al.
4,453,068 A 6/1984 Tucker et al.
4,501,260 A 2/1985 Grace (Continued)

FOREIGN PATENT DOCUMENTS

EP 0 503 302 A2 9/1992

(Continued)

OTHER PUBLICATIONS

One page from Sears website www.sears.com/download/misc/kMInduct.pds entitled *Designed for the Everyday Chef*, USA.

(Continued)

*Primary Examiner*—Daniel L Robinson
(74) *Attorney, Agent, or Firm*—Boyle Fredrickson, S.C.

(57) ABSTRACT

An indoor or outdoor induction cook top system with integrated downdraft or telescoping ventilator uses cross flow or centrifugal blower technology. The system is controlled by an electronic or mechanical controller through a touch device, a slide, or knob. These provide precise control and an efficient way of removal of gases/fumes. A smooth glass cook top incorporates the induction hobs and a downdraft. The ventilator's blower assembly has a fan and a filter. The system uses sensors to detect temperature, fire, effluent, filter change requirements, fan speed, power, and voltage. The system has programmable operations and numerous set points.

20 Claims, 11 Drawing Sheets

U.S. PATENT DOCUMENTS 4,511,781 A * 4/1985 Tucker et al. ..... 219/626
4,562,827 A 1/1986 Cerola
4,603,684 A 8/1986 Kazuo et al.
4,665,893 A * 5/1987 Miyagawa et al. ..... 126/299 D
4,686,340 A 8/1987 Fukasawa
4,701,588 A 10/1987 Fukasawa
4,736,729 A 4/1988 Beach
4,750,470 A 6/1988 Beach et al.
4,757,177 A 7/1988 Suzuki et al.
4,766,880 A 8/1988 von Blanquet
4,784,114 A 11/1988 Muckler et al.
4,798,323 A 1/1989 Platt
4,810,847 A 3/1989 Ito
4,833,288 A 5/1989 Poumey
4,846,146 A 7/1989 Tucker et al.
4,881,870 A * 11/1989 Ritter et al. ..... 415/47
4,886,046 A 12/1989 Welch
4,887,587 A 12/1989 Deutsch
4,908,489 A 3/1990 Panecki et al.
4,934,337 A 6/1990 Falk
4,945,891 A 8/1990 Cecil
4,951,646 A 8/1990 Diekmann et al.
4,960,598 A 10/1990 Swiontek
4,999,466 A 3/1991 Waligorski
5,000,160 A 3/1991 Dunlop et al.
5,001,970 A 3/1991 Graver
5,010,223 A 4/1991 Kim
5,062,410 A 11/1991 Samosky et al.
D327,538 S 6/1992 Falk et al.
5,118,033 A 6/1992 Kula
5,119,802 A 6/1992 Cherry et al.
5,124,519 A 6/1992 Roy et al.
5,153,402 A 10/1992 Quick et al.
5,158,068 A 10/1992 Pickering
5,190,026 A 3/1993 Doty
5,208,217 A 5/1993 Katsoyannis
5,209,217 A 5/1993 Beach et al.
5,213,091 A 5/1993 Beach
5,286,942 A * 2/1994 McFadden et al. ..... 219/630
5,294,765 A 3/1994 Archibald et al.
5,370,576 A * 12/1994 Krofchalk ..... 454/143
5,431,700 A * 7/1995 Sloan ..... 29/25.01
5,519,195 A 5/1996 Keefer et al.
5,530,231 A 6/1996 Walters et al.
5,788,145 A 8/1998 Grahahm et al.
5,986,248 A 11/1999 Matsuno et al.
6,202,638 B1 * 3/2001 Didio-Sayer ..... 126/25
6,230,917 B1 5/2001 Whitnell
6,299,059 B1 10/2001 Bernstein
6,386,498 B1 5/2002 Deco
6,414,290 B1 7/2002 Cole et al.
6,670,592 B2 12/2003 McCarthy et al.
6,695,202 B2 2/2004 Miess
6,700,106 B2 3/2004 Cochran et al.
6,765,182 B2 7/2004 Cole et al.
6,807,962 B2 * 10/2004 Taplan et al. ..... 126/39 B
6,809,301 B1 * 10/2004 McIntyre et al. ..... 219/506
7,051,802 B2 * 5/2006 Baer ..... 165/299
7,423,244 B2 * 9/2008 Baier et al. ..... 219/624
2003/0140918 A1 * 7/2003 Taplan et al. ..... 126/39 R
2003/0206997 A1 11/2003 Winkelman et al.
2003/0226559 A1 * 12/2003 Khosropour et al. .... 126/299 R
2004/0000543 A1 * 1/2004 Dudek et al. ..... 219/655

FOREIGN PATENT DOCUMENTS

EP 1 479 619 A2 11/2004
JP 2005082197 3/2005
WO 99/20116 4/1999

OTHER PUBLICATIONS

Osakagas Technical Sheet from website www.osakagas.co.jp/rd/sheet/061e.htm entitled *Research on Required Exhaust Flow Rate in Commercial Kitchens in the Case of Gas-Fired and Inductoin-Heating Cooking Equipment*, Japan.

*Designed for the Everyday Chef, Induction Cooking Innovation from Kenmore®*, US.

*Research on Required Exhaust Flow Rate in Commercial Kitchens in the Case of Gas-Fired and Induction-Heating Cooking Equipment*, Osakagas Technical Sheet, website ww.osakagas.co.jp/rd/sheet/061e.htm, Japan.

*Induction Cooktops*, Australian Consumers' Association website www.choice.com.au, Australia.

*The Induction Hob Class Induction Technical Training*, Brandt Customer Services Formation CU3-Induction-002UK-Feb. 2003, ElcoBrandt training manual, France.

*10-Bit Rotary Encoder IC Supplants Optical Encoder*, Electronic Products $29_{th}$ Annual Product of the Year Awards, Jan. 2005, US.

Flexpoint Flexible Sensor Systems Inc., Multi-Purpose Bend Sensors® product specification, US.

* cited by examiner

FIG. 9
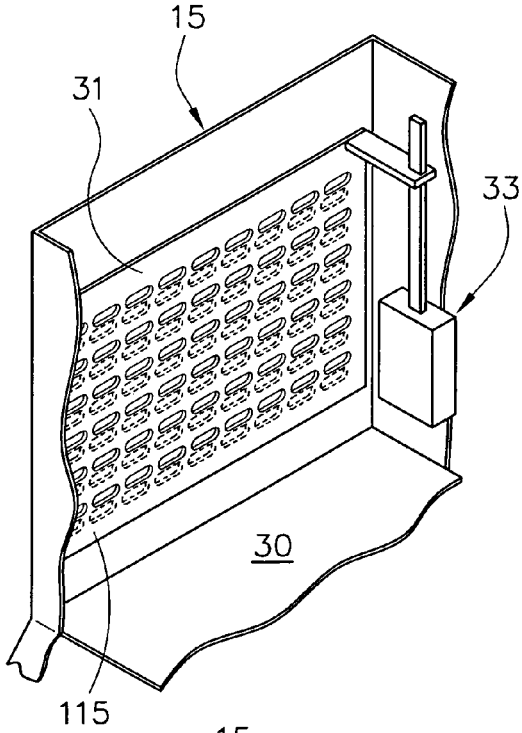
FIG. 10
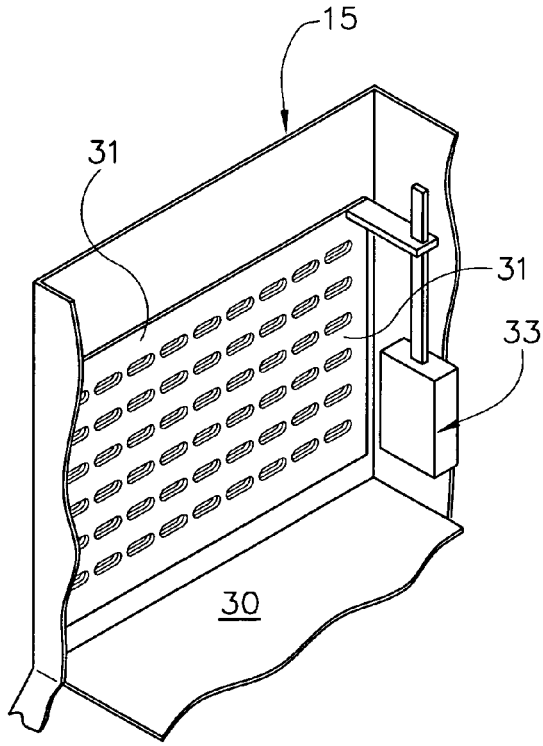
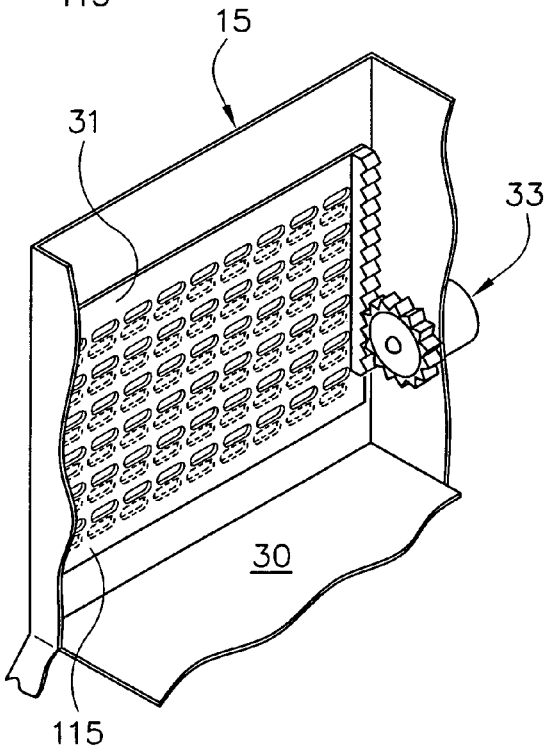
FIG. 11
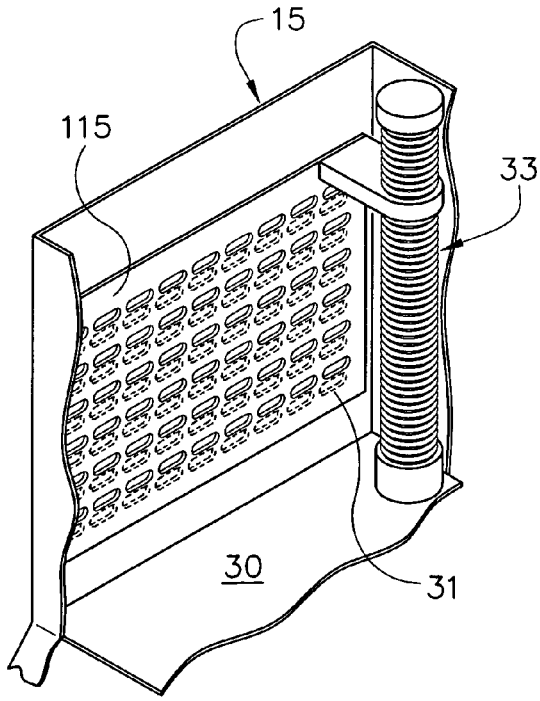
FIG. 12

INDUCTION COOK TOP SYSTEM WITH INTEGRATED VENTILATOR

BACKGROUND OF THE INVENTION

1. Field of the Invention

The present invention pertains to cooking appliances and, more particularly, to an induction appliance integrating a ventilation system having a fixed or adjustable ventilator and an adjustable blower.

2. Discussion of the Related Art

Many different types of cooking appliances produce smoke, steam, or other gaseous contamination during use. Often, it is considered beneficial to utilize some type of ventilation system to evacuate the air borne contamination, either upward through a venting hood or downward into a draft flue. In kitchens, most known venting arrangements take the form of a hood which is fixed above a cooking surface and which can be selectively activated to evacuate the contaminated air. Downdraft vent arrangements are also widely known in the art wherein a cooking surface will incorporate a vent opening that is positioned between different sections of the cooking surface or extends along a back of the cooking surface. These downdraft vents can either be fixed relative to the cooking surface or can be raised relative to the cooking surface to an operating position.

The vertical distance between the cooking surface and a vent hood is typically fixed between 24 and 30 inches. When in an operating position, downdraft vent arrangements known in the art are also limited in this respect. Depending upon the food being cooked and even the particular height of the individual doing the cooking, it may be desired to vary the distance between the cooking surface and the vent hood. On a cooking surface, it is considered beneficial to arrange a vent closer to the cooking surface in order to increase the removal of contamination. On the other hand, it is often desirable to raise a vent hood relative to a cooking surface in order to more easily access different portions of the cooking surface.

Downdraft blowers are multiple speed fans, having a low speed and a high speed. Blowers are typically controlled by mechanical multi-position switches, potentiometer, or rheostat type controls, which set the speed of the fan. For removal of normal cooking odors, steam, and other effluents and contaminates, low speed operations of the downdraft blower has been adequate. However, when using such items as a grill, a blower set at high speed has been better able to withdraw all of the grease laden air from a kitchen and duct it to the outside environment. In cooking systems, such as cook tops and grills with optimized proximity ventilation, cooking gases, vapors and odors are drawn into an exhaust inlet and are better exhausted into the atmosphere. Usually, the exhaust inlet is located adjacent the cooking surface and the inlet to a flow path which serially includes a plenum, a blower, an atmospheric exhaust, and interconnecting ductwork. The flow path to the atmosphere normally extends through a wall or floor of the room in which the cooking system is located, but can also be exhausted into a room if filtered.

The blower/fan is frequently a separate unit from the rest of the cook top and is installed prior to the installation of the unit into a counter top. Some blower systems are provided with a pair of brackets, which permits the selective mounting of the blower to the floor or the appliance itself for discharge either through a wall or through the floor, as required by the installation. Conventional downdraft venting system configurations with an exhaust air inlet located at cook top level work well with electric surface units. However, when used in combination with gas on glass surface units, the downdraft induced air flow at the cook top surface tends to interfere with the gas flame.

A cook top using induction heating for cooking purposes is normally constructed of a metal housing supporting a glass or other cooking surface upon which there is located a number of induction heating coils sandwiched in-between. The housing normally contains an electronic package for use in supplying electric power to the coils. This package consists of a group of interconnected electronic components. The package is connected to the coils with wires that are mounted within the housing. This package is sometimes called the generator and the entire induction system is sometimes called a cooking cartridge.

Because of the heat generated by the induction coil package and the electronic circuitry for operating the induction coil, both of which are located below the cooking surface within the cooking cartridge, it is necessary to provide some form of cooling for the induction coil and its associated circuitry. The fan has been found to be the least expensive and most reliable cooling solution. The known drawback here, though, has been the sensitivity of the air flow, disruption of which causes failure or reduced energy for operation of the induction system.

In order to operate for a prolonged period without the induction system breaking down/turning off, it is necessary then to use a fan that circulates air throughout the interior of the cook top housing so as to maintain the proper temperature for the electronic components employed. Failure to keep the generator cool results in loss of power to the cooking product all the way to a complete unit shutdown. Normally, such a fan or blower is connected into the circuit used to supply power to the electronic components and, thus, is automatically turned on each time the cook top induction element/generator is turned on. However, to avoid overheating, the fan remains on after shutdown of the cooking elements so that heated air within the cook top housing can be removed until a proper safe heat level is obtained.

While the use of a fan in this manner is desirable in preventing heat-caused damage to the electronic components employed, it is also considered a disadvantageous. The use of a fan has two issues when used for cooling an induction cook top. When a fan is used in this manner, noise associated with the fan's operation is present whenever a cook top with induction of the type is used. Too many users find this noise to be objectionable. Further, the use of a fan alone is considered a problem because if air flow is blocked, the unit must be completely shut down for safety reasons. However, a user does not take into consideration whether or not there is heat buildup present within a housing, rather only noting that the unit failed to operate.

Although it is possible to use other methods to keep the temperature down, e.g., by the use of thermostats and various related known temperature sensing apparatus for controlling the flow of current in an electrical circuit, it is known that such expedients are undesirable for any of a variety of reasons, including effectiveness, cost, and reliability.

It has also been shown that a particular air flow path may be helpful, e.g., whereby an internal fan draws cooling air directly into a cooking cartridge, across the induction heating components, out an opening in the bottom of the cartridge, and then exhausts the heated air above the cook top surface through a gap all around the cartridge between a support flange on the cook top surface. There also has been development of a modular cooking cartridge where the internal fan draws cooling air into the interior of the cooking cartridge through the cartridge top, over the induction heating components, and out through exhaust openings in the cartridge top by way of an air flow path including an opening in the cooking cartridge container and an exhaust conduit formed by the cartridge container and an auxiliary housing fixed to the container.

As noted, many conventional cook tops often have integrated downdraft ventilators. Present designs are long rectangular boxes extending below the glass or metal cook top. They extend below the cook top housing as much as 30 inches below the surface or countertop. Attached to this box or plenum is the blower assembly extending outward from the box. The plenum does not in some cases provide any sealing to prevent the drawing of air from the box. Included in the typical downdraft assembly are the blower housing assembly, squirrel cage housing assembly, centrifugal wheel, blower motor assembly, plenum chamber assembly, and a passage between the cook top and the plenum chamber for removal of air from the top surface of the appliance. The box is often of a single-walled or a double-walled construction if you include the cook top box/housing with insulating air in between the plenum and cook top housing. An opening is provided to the interior of the box for exhausting. The centrifugal type fan/blower may be housed in the squirrel cage housing assembly and attached to the plenum. Such a single fan blower may also be attached to the side of the plenum with air flow at 90 degrees from the side of the plenum.

Blowers have been generally designed to draw air downwardly with the use of a centrifugal type fan, and thus remove contaminated air from a cook top surface, remove the interior air of the box, and exhaust it outside or return to the room. A centrifugal fan creates higher pressures than that of an axial flow fan. In such conventional systems, the air flow stream is pulled from the front and sides of the work area to the middle where the ventilator is. The air stream has to then turn 90 degrees downwardly, once inside the plenum chamber. The air stream has to then turn 90 degrees again into a small diameter opening when compared to the size of the ventilator's plenum chamber. The air stream then enters the blower flow efficiency and usually is redirected downwardly again for exhausting. With all this bending of the air stream, air is lost. Thus, large amounts of draw/vacuum/suction are needed to overcome all these losses. With the need for more draw/vacuum/suction comes a larger fan/blower motor, which increases costs, noise, size, and weight.

Present centrifugal fans consist of a wheel with small blades on the circumference and a shroud to direct and control the air flow into the center of the wheel and out at the periphery. The blades move the air by centrifugal force, literally throwing the air out of the wheel at the periphery, creating a vacuum/suction inside the wheel. There are two basic design types of wheel blades in centrifugal blowers—forward curved blades and backward inclined blades.

Forward curved wheels are operated at relatively low speeds and are used to deliver large air volumes against relatively low static pressures. However, the light construction of the forward curved blade does not permit this wheel to be operated at speeds needed to generate high static pressures. Thus, this type is generally not used in downdraft ventilators.

The backward inclined blade blower wheel design has blades that are slanted away from the direction of the wheel travel. The performance of this wheel is characterized by high efficiency, high cubic foot per minute (CFM) operation and is usually of rugged construction making it suitable for high static pressure applications. The maximum static efficiency for these types is approximately 75 to 80%. A drawback to this type is that it must be designed for twice the speed, which increases the cost of the unit.

To date, axial flow fans are not used for such cook top venting. Myths of why include: they cannot provide the static pressures needed for drawing/vacuum/suction, size, and spacing requirements. Axial flow fans come in three basic types of fans. The propeller fan (e.g., the household fan), the tube axial fan, and vane axial fan (cross flow or tangential). The first of these is the most familiar. The propeller fan consists of a propeller blade and a so-called "aperture" to restrict blowback from the sides. Without the aperture, the fan is not truly a propeller fan, since it cannot positively move air from one space to another. The aperture is usually sheet metal/plastic designed to fit closely around the periphery of the propeller. The tube axial fan (found in computers) is literally a propeller fan in a tube. In this case, the tube replaces the aperture. The tube axial fan generally increases flow quantity, pressure, and efficiency due to the reduced air leakage at the blade tips. The vane axial fan (cross flow or tangential) is a tube axial fan with the addition of vanes within the tube to straighten out the air flow. Here, the air flow changes from helical flow imparted by the propeller into a more nearly straight line flow and in the process increases the suction or draws pressure and efficiency while reducing noise. In general, the propeller fan operates at the lowest pressure. The tube axial fan is somewhat higher, and the vane axial fan supplies the highest-pressure output of the three. Vane axial fans are noted for use when available space for installation is limited, such as that of computers. Static efficiencies of 70 to 75% are achieved with vane axial fans. The CFM's and static performance ranges of the vane axial fan are similar to that of a centrifugal fan. Horsepower requirements are about the same for both designs.

The present downdraft ventilator designs also present problems when integrated into a cook top. Because of the low profile, spilled food and liquids can enter the grate and removal of the items that are not captured by the filter cannot be removed easily. This is due to the required depth of the plenum and the narrow box size.

The present design of ventilators is also often large and bulky. Examples would be downdraft ventilators built into a cabinet or used on an island counter top. There, the space below the unit is not available for a user to use for storage due to the centrifugal blower below and the size of the plenum presently used. Large size also limits the downdraft ventilator from being placed in other areas or used with other products below the cook top. This also limits the downdraft ventilators from being used as a freestanding unit, as a mobile unit, used in a cabinet (e.g., suspended), or in areas that do not have the ability to support a large structural frame below.

A document from Osaka Gas Company entitled "Research on Required Exhaust Flow Rate in Commercial Kitchens in the case of Gas-Fired and Induction-Heating Cooking Equipment" illustrates some problems when using ventilators for removal of contaminated air. For example, with the use of induction heating cooking stoves, even a weak side draft caused the cooking contaminants to move outside the exhaust vent because there was not enough energy to raise the air up for the collection to take place. These results show that when induction-heating cooking equipment was used in a real commercial kitchen environment where the room air was disturbed, oil smoke or other cooking contaminants were not fully removed by the exhaust vent.

Present day induction coils are made to a critical temperature of 200° C. beyond which they undergo damage to the insulation between the wires. There have been attempts to do other things in the coils, especially at the center of the coil, by providing for a temperature sensor, for example a thermistor, to prevent the overshooting of temperature limits. However, this type of localized sensor has very localized action and does not take into account the entire surface area of the generators/inductor. If the sensor does not work properly, there are situations in which the critical temperature may be reached and even exceeded causing damage. This is especially so when an empty pan is placed above the element supplied with current, or when food to be cooked has to be deep-fried. The results of these attempts ended with fans being added to keep the temperature in the proper operating range.

The below-referenced U.S. patents disclose embodiments that were at least, in part, satisfactory for the purposes for which they were intended. The disclosures of all the below-referenced prior United States patents in their entireties are hereby expressly incorporated by reference into the present application for purposes including, but not limited to, indicating the background of the present invention and illustrating the state of the art.

U.S. Pat. No. 4,191,875 is directed toward controlling operation of an internal electric fan for cooling an induction heating apparatus. A thermistor is located near the induction heating apparatus and controls the operations of a fan. The thermistor, in this invention, is in series with a variable resistor and a capacitor. When the capacitor is charged to a predetermined voltage through the thermistor and variable resistor, it will fire a signal through a component to allow current to flow through an electronic component and operate the fan motor. This invention also shows a plurality of air inlets and outlet holes in the walls of the housing so that the fan may randomly pull air in one side and exhaust it out the other side of the housing after it passes over the induction heating apparatus. This patent notes the critical nature for the air flow to be undisturbed when cooling.

U.S. Pat. No. 4,415,788 describes an induction cartridge having a forced air cooling system where a fan draws air into the cartridge cavity, circulates it around the induction heating components, and exhausts it out an opening in the bottom of the cartridge. This patent discloses exhausted air being returned to the kitchen environment through an exhaust gap around the periphery of the cartridge between the housing top and the bottom of a support flange. It also suggests that a separate drop in cartridge be made to isolate the air stream to the induction elements from any other source of blockage.

Another approach to protecting the components within induction cooking was illustrated in U.S. Pat. No. 3,710,062. This invention includes a relatively complex thyristor gating circuit for precisely establishing the recharge period between conductive cycles of the inverter to cause the reapplied forward voltage across the thyristor to be insensitive to the loaded or unloaded condition of the work coil. However, it was found that this approach was incapable of protecting the inverter when loaded with a highly conductive utensil due to the heat buildup. A second circuit was illustrated in U.S. Pat. No. 3,775,577, which was included in the appliance based upon establishing a pedestal of predetermined length initiated by the start of a conductive cycle and assuring that commutation occurred within the period set by the pedestal. Again, issues still remained as to the cooling requirements needed with different types of loads.

Other known induction cooking appliances in prior patents, (e.g. U.S. Pat. Nos. 3,781,505 and 3,820,005) have attempted to protect the inverter by utilizing constant duty cycle controls for measuring the conductive interval of the inverter and adjusting the length of the recharge period to maintain an approximately constant duty cycle. As such, controls increase the operating frequency in response to a decreased conductive interval (as is normally caused by loading of the inverter) and they are not particularly suited to protecting the inverter from improper loads. In certain instances, presenting a highly conductive utensil to the work area causes a substantially shortened conductive interval, which, in turn, causes the constant duty cycle control to raise the operating frequency even higher, thus further aggravating the situation. The end result is increased temperature and the need for more air flow to cool the unit down.

Air flow systems have been generally utilized for control protection purposes in induction and other cook tops. For example, U.S. Pat. No. 3,859,499 discloses an air flow system for heat-cleaning ranges in which room air is drawn through air inlets located along the sides and top of an oven opening. The air passes through a space between the range's outer casting and the inner oven cabinet. A blower draws air into the upper air flow passageway during an oven heat-cleaning cycle. The blower exhausts air to the atmosphere through a vented splash panel.

U.S. Pat. No. 4,191,875 discloses a fan for circulating air through an induction cook top housing and maintaining the temperature of the electronic components. The fan includes a conventional electronic motor to circulate air both in and out of the housing through various openings provided in the housing. The speed of the electric fan is proportional to the degree of induction heating of the heating elements.

U.S. Pat. No. 4,549,052 discloses a cooling system for an induction, cooking cartridge. This system includes an internal fan for cooling the various induction heating components. The cooking construction has a unique air flow, which enters a mounting recess in at least two areas and enters the cartridge cavity at the bottom and the top. The air flow is directed over the induction heating circuitry for cooling and is exhausted through the fan to an exhaust conduit.

However, as the above attempts are lacking, there exists a need for a state-of-the-art induction cook top with integrated downdraft or a telescoping ventilator using cross flow or centrifugal blower technology to accurately control speed, venting, reduce noise and size, and better remove contaminates. There also exists the need for an accurate method of controlling the operations and a need for the user to be able to view/see the operations, speeds, set points, functions, and view the contents on the cook top. There is also a need for a proper vent design so that drawn air does not improperly remove air at the burner and a need for a system that is easy to clean and maintain.

Further, there is a need for controls to be less susceptible to the environment. There also is a need for a remote control, a need to accurately apply and control heat output as it is returned to the room, and a need for a new design that can be used in a variety of places and spaces.

SUMMARY OF THE INVENTION

The inventive system can be of a fixed or can be of a telescoping ventilator integrated into the smooth glass ceramic induction cook top for removal of contaminated air. The system can also incorporate a cross flow or centrifugal blower system for the source of air removal device. The induction cook top with integrated downdraft or telescoping ventilator using cross flow or centrifugal blower may be combined with other counter top range items in the house thus reducing the need for an over-the-head (updraft) type ventilator and increasing space below.

Such a system is preferably incorporated into a cook top/grill, built into a range, or other appliance and has a single to a plurality of induction/inductor heating elements located on a counter, range, or other surface. However, this inventive system may also be used in combination with gas or electric type heating elements found on appliances. The ventilator preferably includes a base housing or plenum and cross flow assembly. The base housing is attached to a cook top or other surface and is preferably permanently fixed. The plenum is only the depth of a cook top housing member and is preferably sealed to the glass/metal from leaking of air. The invention preferably incorporates a keypad and control circuit, which enables adjustment of the fan speeds and sensors. The control of the ventilator may be integrated into present controls, located on the cook top, remotely located, or parts of the keypad/control can be split between the ventilator and other locations. The controls may include an electronic control board that may be located on the cook top, or remotely, or parts of the electronic control board may be split between the cook top and other locations. The control board also preferably determines that a stop/obstruction is present by the increase in current, air flow, voltage, or resistance, and accordingly adjusts or turns off the power supply.

The present invention induction cook top with integrated downdraft or telescoping ventilator using cross flow or centrifugal blower technology assembly preferably includes a cook top housing assembly, a cross flow blower assembly, a ventilation system, a ceramic glass cook top, an opening for the vent or downdraft, and a filter. The cross flow blower assembly is composed of a motor item, fan wheel/blades, and a blower housing preferably attached to an air passage in the induction cook top housing. These items, motor, fan wheel, housing may be one assembly or may be made so as to be separate components integrated into a plenum. Seals are provided for sealing the space between plenum or base housing and walls in the passage created by the cook top housing. The seal also makes contact with the vent or grate member to provide sealing on the cook top. It is also important that the sealing provide a barrier to the air flow so as not to disrupt the cooling air to the induction generator in any way. This provides for better air loss control and reduces side air removal. This method need not use the double wall construction used in centrifugal types for the inner or base housing as the plenum which is now part of the cook top passage and the cross flow blower is preferably attached to the cook top housing. This single box design reduces the cost of manufacturing. A centrifugal type blower assembly may also be used.

A cross flow blower assembly may be used as long as the surrounding surfaces can take the air movement and not be interfered with. Air moves down the passage of the cook top lower housing to the blower assembly from an opening in the glass ceramic or cook top surface. The advantage to using this method is that the base plenum housing is eliminated and the need for sealing from the base plenum housing to the cook top member is eliminated.

It should be noted that the downdraft ventilator may consist of multiple cavities or compartments in the same appliance or multiple fans/blowers and that the invention may be built into/on a mobile island or cart for use with grilling/cooking equipment. A mobile unit is preferable so one does not need to have it installed into/on a cabinet or structural or supporting frame and thus there is now space below for use by the user.

From a design standpoint, anyone skilled in the art will be able to see the construction of the present invention being a smooth glass/ceramic glass/metal, etc. induction cook top with a ventilation system that will not affect the needed air flow for cooling the induction generators, electronics, and space. Because of the invention's constructions, methods, and designs, one may have nearly limitless designs, features, appearances, elevations, styles, operations, sensing, and performances for both fixed and telescoping downdrafts. With the ability to properly seal/isolate the ventilator from the induction generator's air flow, one can have great flexibility in ventilator shapes, and in where the downdraft may be placed as well as different looks, which will afford users the advantage and benefits offered by other products.

With reference to the present invention, also included is a fan/blower. Preferably, this represents the cross flow/tangential fan/blower assembly. In accordance with this invention, there are a number of fans/blowers that can replace or add to the style shown. Fans/blowers for replacement or addition come in many shapes and sizes and may be formed and bent into nearly any shape. These fans/blowers may be located along/on the induction cook top's housing or any other surface. Using a fan/blower improves air removal throughout the inside cavity. The use of two or more fans/blowers can be used to improve on the air removal in the inner cavity and exhausting. See, e.g., FIG. 4. The use of a variety of electronics and controls for the blower may also greatly improve on the removal of contaminated air. Greater control means less flow loss and fan noise and smaller overall blower size. Preferably, the assembly of a fan/blower assembly is comprised of a housing, fan, and motor assembly with bearings to support the fan and motor on the housing.

Blower/motor specifications can significantly influence the performance and reliability of cooking units. First, placing the blower assembly as close to the items on a cook top location as possible increases the effectiveness of drawing contaminated air in and out. Second, reducing the number of bends the air has to flow around helps reduce air flow losses. Also, a cross flow blower does not need the air stream to change directions as does a centrifugal type fan/blower. Further, using a cross flow blower increases in effectiveness, and thus permits the size of the blower/motor to be reduced. Thus, the noise level is reduced. Long-wheeled cross flow blowers and tangential blowers provide other advantages including wide uniform air flow over the width of the unit without gaps, uniform air delivery for high capacity, geometry that results in a significantly quieter blower/fan and a smaller profile for the same length of exterior housing. Good speed control of such blowers may be achieved by using resistors, regulating transformers, and electronic controllers for voltage regulation. Other advantages include: the ability to design for overload protection, no warming of the air as the motor is situated outside the air flow, longer bearing life, and higher efficiency. The energy saving from not having to turn on a large blower motor provides added benefits to the user in the way of cost saving. Another added benefit is a lower profile so that there is more useable room under a range/cook top or in a cabinet. The fan may be used for not only ducting heated air and effluent but also moisture.

The present invention preferably includes a control board and related circuitry to control power/control to the motor, control to the fan(s)/blower(s), control to an electronic controller, glass touch pad, or mechanical controls. Controls can be built with power control to sensors. AC or DC power supplies the electronic current to the board and other components. As mentioned, the control board can be located on/in the cook top or remotely. It can also be divided into more than one board and located at different locations. The electronic board also can use the flex technology, which permits the board to be or bend into any shape. There are a number of types of controls that may be connected to the board. For example, one control may have a real or simulated mechanical look with electronics below and a knob for turning on the top. Also, a rotary encoder for high precision sensing and control such as the position detection may be present for control at different heating levels.

With reference to the present invention, a passage in the cook top housing preferably provides for a filter. While typically found in the opening called plenum, there are a number of ways to attach filters including attaching the filter into a recess in order to lock the filter in place, snapping into or dropping into place, or using a filter tray.

A flow sensor may be used with the filter for the detection of air flow. Such a sensor improves on the efficiency and required servicing of the filter. A flow sensor in, on, or behind the filter area and communication with the electronic control board preferably detects the movement or reduced movement of air passing by the sensor. This air movement may have set limits as to when the filter needs changing. These limits can be adjusted for the type of filter used, which may be metal mesh, louver, carbon, or a combination of these types. A different way is to have the electronic control board set the limits automatically based on percentage of blockage.

Other sensors for air flow may include the simplest and lowest cost types such as a strain gage on a reed, in which the air moving across the reed bends the reed causing the strain gage to send a signal to a sophisticated electronic control board system. In such a system, as the air is reduced, the signal changes and the electronic control board signals the user to change the filter. Signaling the user may be by sound or by lights or other methods such as the system not operating or combinations of signals. Another low cost method is by magnetics. This would be very similar to the one above, but would be based on detecting a magnetic gain or loss. Another sensor type is a differential pressure sensor, which has one open end on the outside of the filter and the other side behind the filter. The difference between the sensor openings can be signaled to the electronic control board, which then can watch for the changes either up or down and then when a set point is reached, signals the user for change. The microbridge mass air flow sensor is another sensor, which operates on the theory of heat transfer. The other types of possible sensors are: solid state Hall effect sensors, piezoresistive sensors, calibrated pressure sensors, transducers, bonded element transducers, transmitters, and ultrasonic, Doppler, IR, and fiber optic sensors.

With the present invention, it is also desirable to better regulate the electrical current to the cross flow/tangential fan(s)/blower(s) such that the power output can be increased or reduced with improved accuracy, and similarly increasing or decreasing the speed output from the cross flow/tangential fan(s)/blower(s) with greater accuracy. Determining the needed air flow loading for the inner member cavity and only supply that amount of power, may be done with electronics. This method may provide an energy star rating and improved energy use.

Another aspect of the present invention is to have a nearly infinitely selectable speed fan adjustment range. This can be done, for example, by having the user touch down on a glass resistance keypad until the speed required is reached. Once the required speed is reached, the electronic control board may completely cut off current/power to the blower(s)/fan(s) slowing or stopping the user's speed adjustments. The keypad may have one or two keypad locations for operating up or down the speed by the user. Using two or more locations for independent operations can provide user better control by being simple. The use of a display to show user the speed level may assist in finding proper speeds, which then can be programmed into the electronic control board for repeated operations later.

Sensors may be used with the electronic board to optimize system operation. These include: current sensors to monitor AC or DC current, adjustable linear, null balance, digital, and linear current sensors, and magnetoresistive, closed loop current and digital current sensors, as well as a variety of others.

The present invention may also include the ability to supply a fresh stream of air up the sides or back of the downdraft ventilator, thus providing a supply of burnable air for a gas cook top, which has been a problem with present units due to the blocking by the ventilator. The air is preferably ducted out the bottom or along the sides or back of a downdraft ventilator tapping of the vented air, and returns the air at the bottom of the grate to the cooking area.

These, and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIGS. 9-12 illustrate enlarged broken away views of vents of various embodiments of the present invention;

Figure 1:
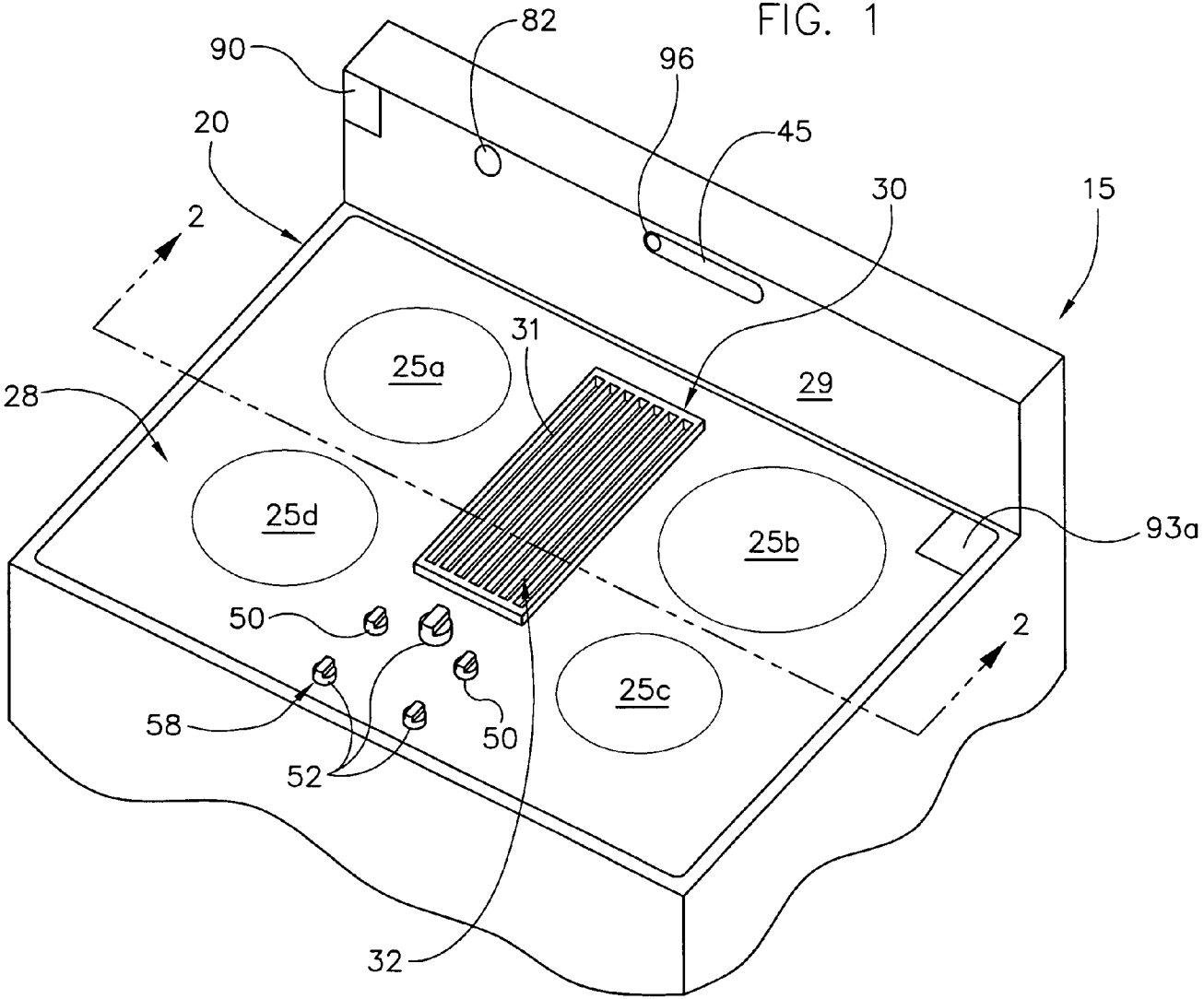
FIG. 1 illustrates a perspective view of the appliance of the present invention.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the words "connected," "attached," "coupled," and "mounted" and variations thereof herein are used broadly and encompass direct and indirect connections, attachments, couplings, and mountings. In addition, the terms "connected," "coupled," etc. and variations thereof are not restricted to physical or mechanical connections, couplings, etc. as all such types of connections should be recognized as being equivalent by those skilled in the art.

Further, before any embodiments of the invention are explained in detail, it is to be understood that the invention is capable of other embodiments and of being practiced or of being carried out in various ways. Also, it is to be understood that the phraseology and terminology used herein is for the purpose of description and should not be regarded as limiting. The use of "including," "comprising," "at least one of," or "having" and variations thereof herein is meant to encompass the items listed thereafter and equivalents thereof as well as additional items.

DESCRIPTION OF PREFERRED EMBODIMENTS

The present invention and the various features and advantageous details thereof are explained more fully with reference to the non-limiting embodiments described in detail in the following description.

1. SYSTEM OVERVIEW

The appliance of the present invention preferably includes a cook top with at least one induction heating element on a cooking surface (sometimes called an "induction hob"), a cook top vent for removing at least one of air and effluent from the cook top to a lower cavity, and a blower assembly in fluid communication with the vent. The appliance may be an outdoor unit, an indoor unit, a mobile unit, an island unit, a fixed location unit, a drop or slide in cook top, and/or a grill. In such units, the cooking surface is preferably glass.

The vent preferably comprises a vent cover for covering a vent hole. In one embodiment, the vent preferably includes a telescoping downdraft. The vent or ventilator is preferably operably connected to the cooking surface for drawing air and effluents therefrom and has an inner cavity and a plenum. The plenum preferably has walls surrounding a chamber. In other embodiments, the ventilator folds, slides, or retracts. The vent may include an actuator-driven venting system having at least one of: a motorized, electromagnetic, solenoid, and powered venting control. Such electronic exhausting controls are preferably in communication with the vent. These controls may be used to, for example, close a flap or door to the vent when not in use. In one embodiment, these controls are integrated with those of the induction hob and the blower. The downdraft has a shape that may be rounded, squared, oval, triangular, and rectangular.

The blower assembly preferably includes one of the following: a system that manages air and effluent from the cook top and cooling air from the induction heating element, a regulator for electrical current to a blower motor such that the power output can be changed as needed, a tangential fan to circulate air downward, a cross flow fan, a centrifugal fan, a fan that can be remotely located in attached duct work, a fixed speed fan, a variable speed fan to control air movement, a squirrel cage wheel fan, a fan with adjustable speeds that may be preset, a fan used as a power vent for removing air, a fan for management of moisture build up and controlled by a humidity sensor, a re-circulating system, a mechanism for sucking air from the appliance top, a fan for management of heat buildup and controlled by a heat sensor, a large chamber plenum assembly, and a fan to move air through a heat exchanger. The blower has an AC or DC motor. The fan may include blades of straight or skewed design and a long length axial wheel. Preferably, the appliance's blower operation is synchronized with the operations of the induction hob and its cooling system.

A controller is preferably present to control the appliance, e.g., operations such as ventilator movement, element heating, etc. In one embodiment, the controller is preferably an electronic controller to control blower speed. Such an electronic controller includes at least one of: a touch device, a keypad, a slide, and a knob. The keypad controller may be located on the cook top, located remotely, split into parts between the top and another location, or matched to a size, appearance, and function of another neighboring appliance and the cook top. The controller includes an electronic control panel having at least one of a piezo, tactile, membrane, inductive, capacitance, and resistance device. The panel is constructed from at least one of: glass, metal, plastic, wood, and composite substrates. The controller is at least one of: a piezo, capacitance, and resistance type touch control keypad for use with any size appliance, a membrane switch, a tactile, resistance, inductive, capacitance control with decorative overlays, labels, or trim, and a complete control panel assembly. The controller is preferably installed in a plane relative to the cooking surface and may be flush, raised, recessed, and remotely located. The controller may have an integrated control board. The board may be in at least one of the following locations: on the cook top, remotely, and split into several parts between the cook top and other locations and attached thereto. The circuit board may also include: a microcontroller, an IC, a driver, a PC board, a processor, and a power controller in communication with the electronic controller.

In another embodiment, the controller is a remote control for wireless control of an operation. A device may be provided for making such a controller at least one of: automatic with no user interface, semi-automatic with a limited user interface, and completely manual with the user setting, operating, and adjusting the system or parts thereof. As such, the controller may also include a programmable controller to monitor at least one of: temperature, operations, speed, time, blower efficiency, lighting, and air movement.

In another embodiment, a sound activated control is used to control at least one operation of the appliance. A computer system including a full memory and processor may also be used for connecting the appliance to a whole house system. A display interface may also be available with the controller to help the operator with the functions, temperatures, speeds, need for a filter change, and time. The controller may have a graphic specific to the design and function of at least one of the blower assembly, lighting, and the ventilator.

One or more sensors for the cook top may also be used to sense various environmental conditions. In one embodiment, a sensor scans the cook top for an item placed thereon. It may then provide feedback to the appliance to operate a fan in the blower assembly. Sensors for the appliance may be also used to detect at least one of: filter buildup, back pressure, air flow, gas, smoke, heat, temperature, filter change requirements, speed, power, resistance, voltage, programmed operations, and set points.

The appliance may also be equipped with at least one of: an output display, a rotating display, an LED display, a LCD display, a sliding panel, a retractable display, a removable display, a fixed display, an illuminated display that can be adjusted in color and intensity, a plasma display, a dot matrix display, a vacuum fluorescent display, and a pop up display. The display is preferably mounted on the cooking surface or backing for easy viewing. The display device preferably displays to the operator at least one of: operations, temperature, functions, range position, and times.

The appliance preferably further comprises movable lighting on either the backing, cook top, or the ventilator for illuminating a work surface. The lighting can be any device to illuminate the cook top including a device that is at least one of: an adjustable light level device, adjustable light position, hidden lights, exposed lights, a series of lights, a mini fluorescent tube, mini neon tube, an LED, rope lights under a decorative flange trim of the ventilator, recessed lighting, direct lighting, and indirect lighting.

In one embodiment, the ventilator is adjacent at least two cavities and has at least two blowers. The second blower preferably has a speed control independent from a first for moving a different volume of air away from a second induction-heating element.

A filter is preferably attached below the vent with the cavity at an angle and coated with an agent for cleansing air that passes therethrough.

The appliance preferably also has a heat exchanger in communication with the vent for at least one of: extracting effluents, cooling drawn air to a proper temperature, and recycling air back. This heat exchanger includes at least one of: a heat pump, an electronic cooling device, a refrigeration unit, and a magnetic cooling device. The heat exchanger may be used in such a way to turn the downdraft into a cooling/heating ventilator.

One embodiment of the appliance has a fire suppression system operably connected to the cook top for controlling fires and added safety. An IR system may be employed in such a system. The IR system may be operably connected to the cook top for detecting at least one of temperature, resistance, heat, fire, distance, moisture, and steam. The IR system may employ a variety of sensors. Such sensors may have at least one of an electronic, an electromechanical, and mechanical component. This system may also have an electronic touch controller in communication with the circuit board.

The appliance may also include other specialized devices, such as, a device for detecting and controlling of speed for the blower, an air flow sensor for detecting the flow of air past a filter, a sensor that measures the air flow and provides a signal to user for filter replacement due to restricted air flow, a beam or other detector sensor to scan the surface of a work area for an item placed on the work area and to provide feed back or control with automatic operation of the ventilator, a means for detecting gas flow, an ultrasonic sensor, a thermo detection device for the control of the downdraft, a digital CO2 sensor, an NDIR technology sensor, and a sensor having the ability to detect back pressure that triggers an increase in fan speed to maintain the proper volume of extraction.

2. DETAILED DESCRIPTION OF PREFERRED EMBODIMENTS

Various embodiments of the present invention are shown in FIGS. 1-14 which are described in additional detail below.

FIG. 1 shows one preferred embodiment of the appliance 15 of the present invention.

Now referring specifically to FIG. 1, the appliance 15 includes a cook top 20 with induction heating elements 25*a*-25*d* on the cooking surface 28. In one preferred embodiment, a backing 29 is provided, for example, splash protection. The appliance 15 and cooking surface 28 are preferably comprised of a metal, glass, stone, plastic or other materials.

A cook top vent or ventilator 30 is provided to appliance 15 for removing effluent and hot air from the cooking surface 28. The ventilator may consist of a vent cover 31, which covers a vent hole 32. Below the vent cover 31 is a lower cavity (not shown) which preferably attaches to a plenum (not shown). The outer skin of the ventilator is made from preferably metal, although glass, stone, plastic or other materials may be used. Because of the flexibility of the design and the low profile of the blower assembly, the outer shape of the ventilator can be styled to meet nearly any requirements.

Also shown in FIG. 1 are various controls 58 which may include slides 50 and knobs 52 to control, e.g., heat to heating elements 25*a*-25*d* and also in another embodiment the up or down movement of the ventilator 30. On the backing 29, a scanner 82 may be mounted. Also mounted on the backing may be lighting 45 which preferably includes a control for the lighting 96. In one preferred embodiment, a sensor 90 is also provided.

Figure 2:
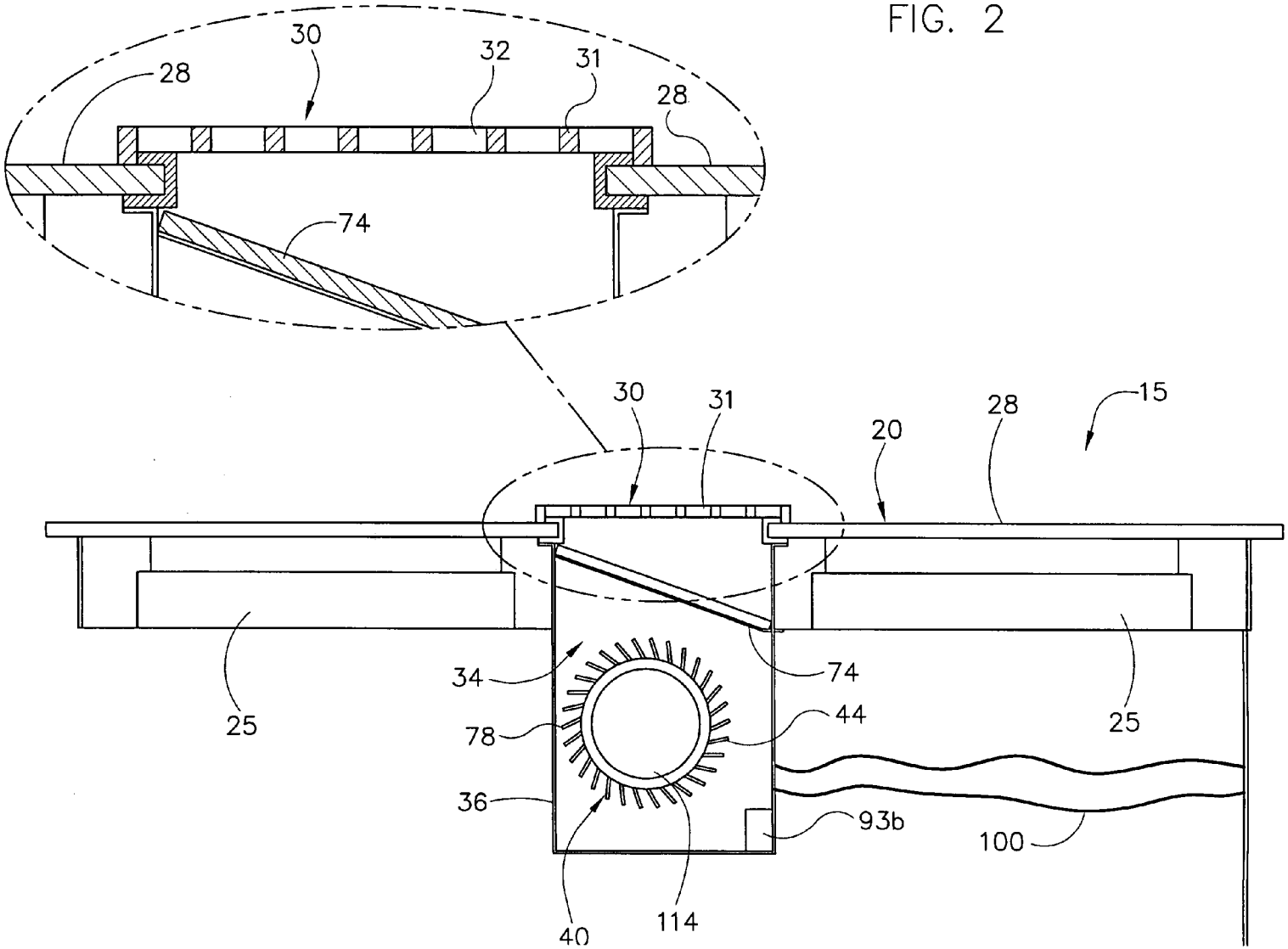
FIG. 2 illustrates a cutaway front view of the appliance of FIG. 1 along the line 2-2.

FIG. 2 shows a cutaway of the embodiment of FIG. 1 along the lines 2-2. In FIG. 2, the lower cavity 34 and the plenum 36 are shown. Inside the cavity 34, is preferably a blower assembly 40 which may include a fan 44. The blower may alternatively be located in a plenum chamber. The fan may have fan blades 78 protruding from a center portion. Above the fan and below the vent, is preferably mounted a filter 74. The filter may be mounted at an angle to allow for ease of runoff of any grease or other unwanted materials. In one preferred embodiment, the fan is a cross flow blower 114. In the preferred embodiment shown in FIG. 2, duct work 100 connects the lower cavity 34 with an outside vent.

Figure 3:
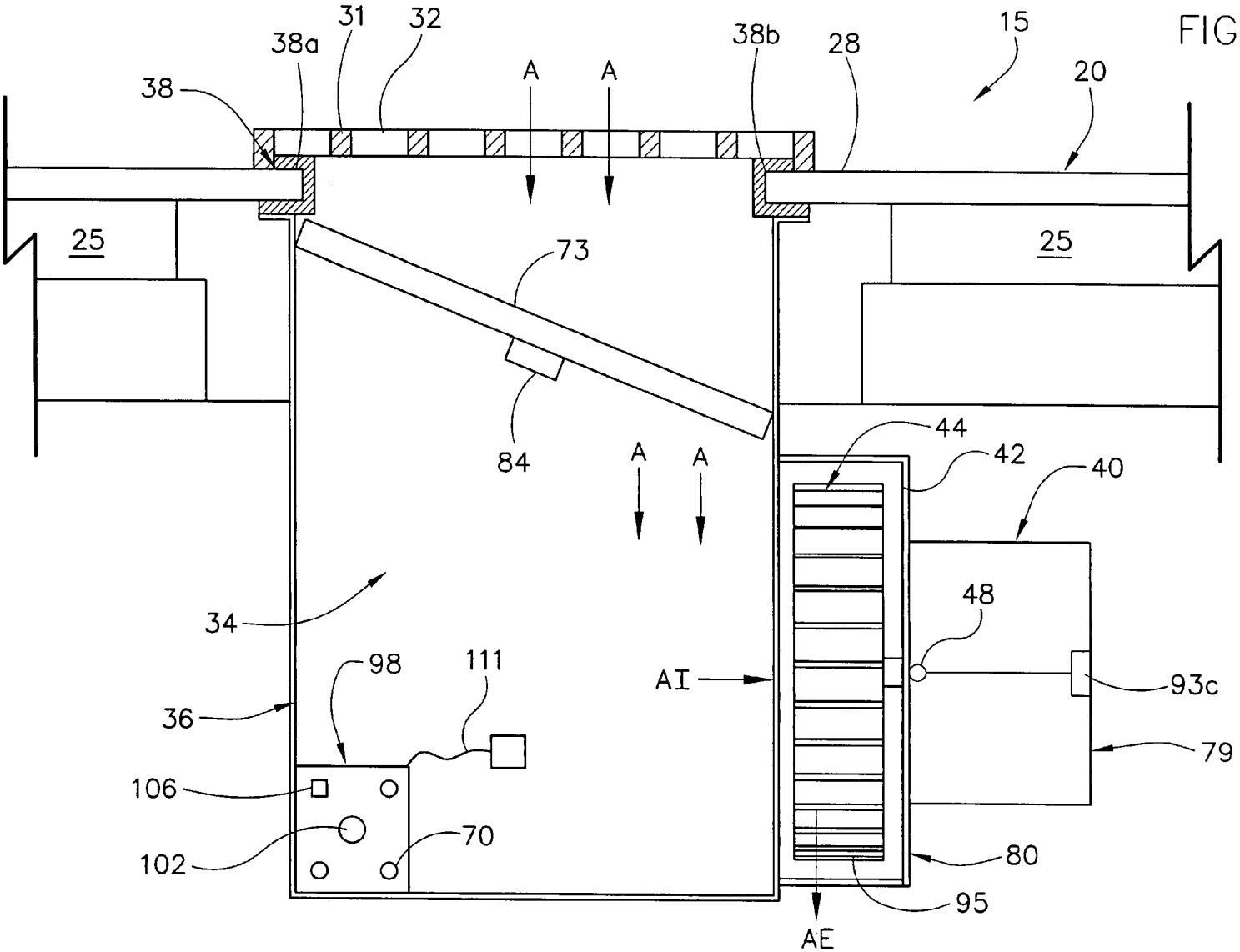
FIG. 3 illustrates a cutaway front view of another embodiment of the present invention.

FIG. 3 shows another embodiment to the current invention. In this embodiment, the vent cover 31 includes a grate which has a series of vent holes 32. A system for managing air flow 38 is also provided. In this embodiment, the system for managing air flow 38 includes seals 38*a* and 38*b*. Of course, many other components are possible. A filter assembly 73 is also present. A means for detecting filter buildup 84 is attached to the filter assembly 73. Within the plenum and the lower cavity, is a control board 98, which includes a micro-controller 70, a processor 102, remote control wiring 111 and preferably a programmable control 106. On one side of the plenum is mounted a blower assembly 40. The blower assembly 40 includes a fan 44, which in this embodiment is a centrifugal flow fan 95, and a housing 42. A regulator 48 for controlling the electric current to the blower assembly 40 may be connected to a heat sensor 93*c*. When the heat sensor 93*c* detects an increase of heat, the sensor may signal the regulator to shut off electric current to the blower assembly. Here, the fan is preferably operated by an AC motor 79. Centrifugal fans are sometimes referred to as wheel fans 80.

In FIG. 3, air, shown by arrows A, enters through the grate 31 and travels downwardly into the cavity in the appliance 15. The air (arrows A) then travels past the filter assembly 73 and is drawn toward the fan assembly 40. The air enters into the fan assembly (arrows AI) and then is exhausted from the appliance preferably out an exhaust vent (see, e.g., arrows AE). Of course, the air entering the vent grate may be laden with cooking gases, odors, effluents, grease, oils, etc., but the air exiting (arrows AE) is preferably cleaned air.

Figure 4:
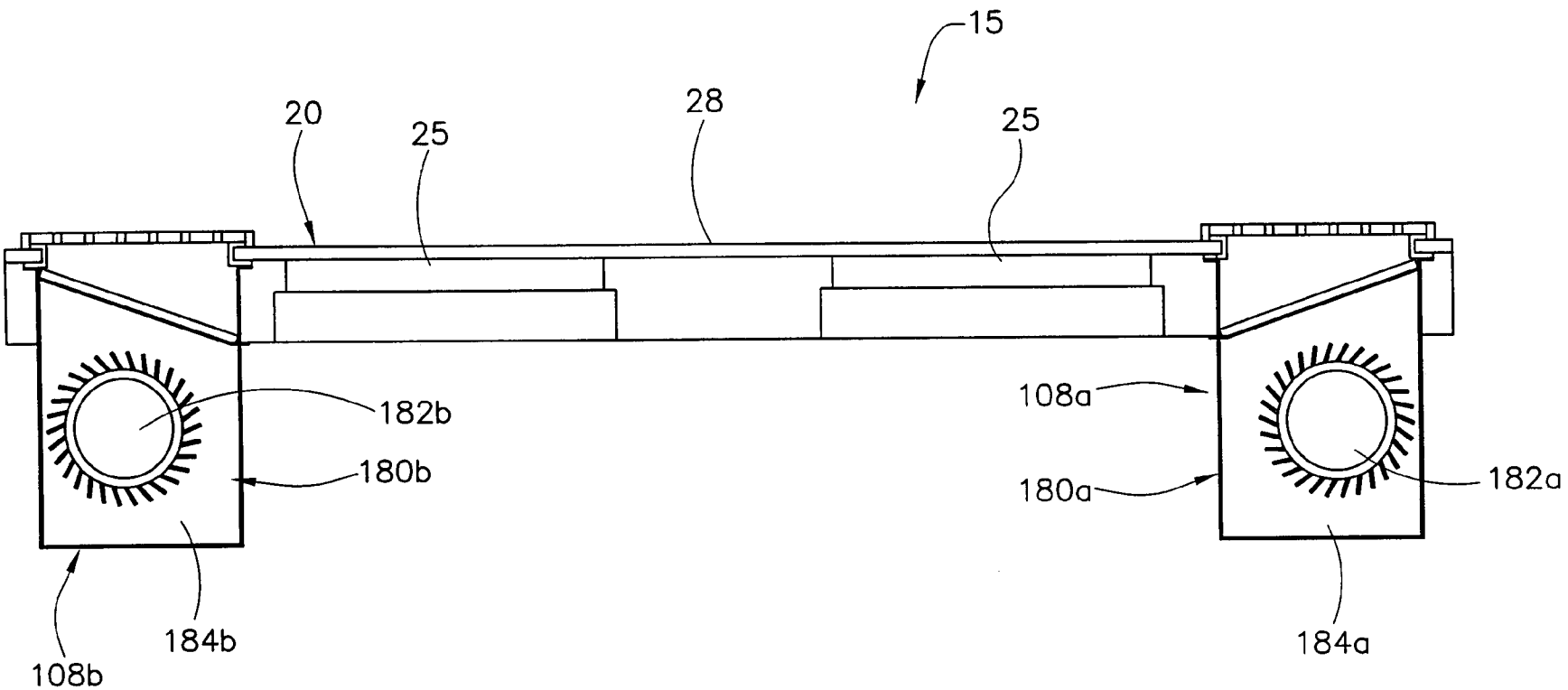
FIG. 4 illustrates a cutaway front view of yet another embodiment of the present invention.

FIG. 4 shows another embodiment of the appliance 15 having a cook top 20 with assemblies 108*a* and 108*b* to provide and enhance cooling to the induction heating elements 25 and the cooking surface 28. These assemblies are provided with a mechanism for sucking air. In this preferred embodiment, the mechanism for sucking air includes a first blower assembly 180*a* and a second blower assembly 180*b*. The blower assemblies include a first fan 182*a* and a second fan 182*b*. The fans are preferably mounted in cavities 184*a* and 184*b*.

Figure 5:
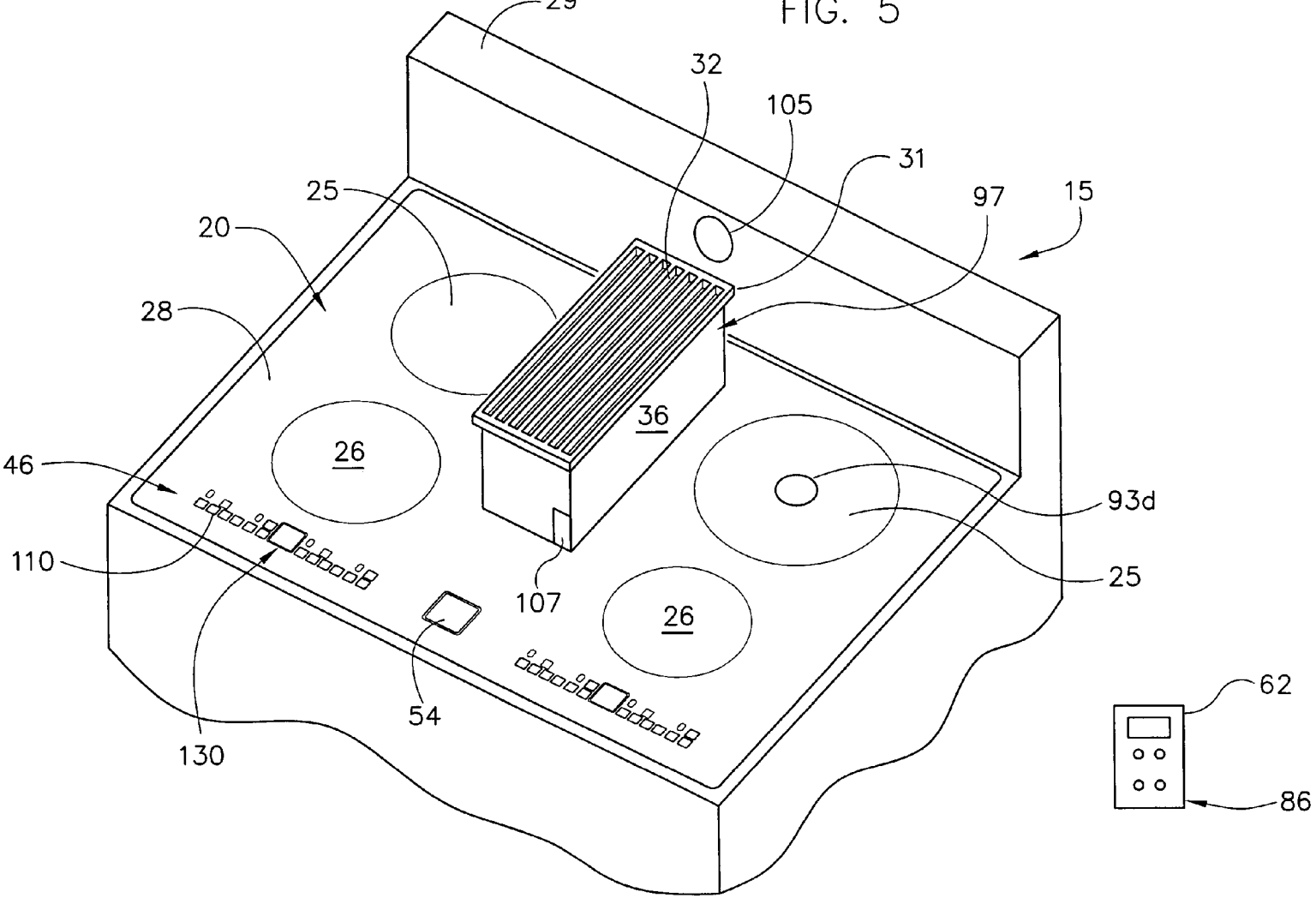
FIG. 5 illustrates a perspective view of yet another embodiment of the present invention.

Another embodiment of the present invention is shown in FIG. 5. There, the appliance 15 has a cook top 20 which has two induction cooking elements 25 and two regular electric heating elements 26. As such heating elements are well known in the art, these will not be described in further detail.

The center of the cooking surface 28 preferably has a telescoping downdraft ventilator 97. The ventilator includes a plenum 36 and a vent cover 31, which covers a vent hole 32. This telescoping ventilator 97 can move up and down relative to the surface to provide maximum ventilation. Also included on the cooking surface are means for adjusting the ventilator's fan speed 46. Preferably such a means includes a keypad 110 having an output display 130. Also included on the cooking surface may be a membrane switch 54 which in this embodiment preferably controls the up and down movement of the telescopic ventilator 97. Integral with the induction heating element 25, may be a heat sensor 93*d* to detect and control heat to the unit. In this embodiment, a remote control unit 62 may be included for remotely controlling the appliance 15. The remote control unit 62 may be integrated into computer system 86 to add further appliance integration and control. Such a unit may be integrated into a whole house system (not shown) which controls various appliances and household operations.

Figure 6:
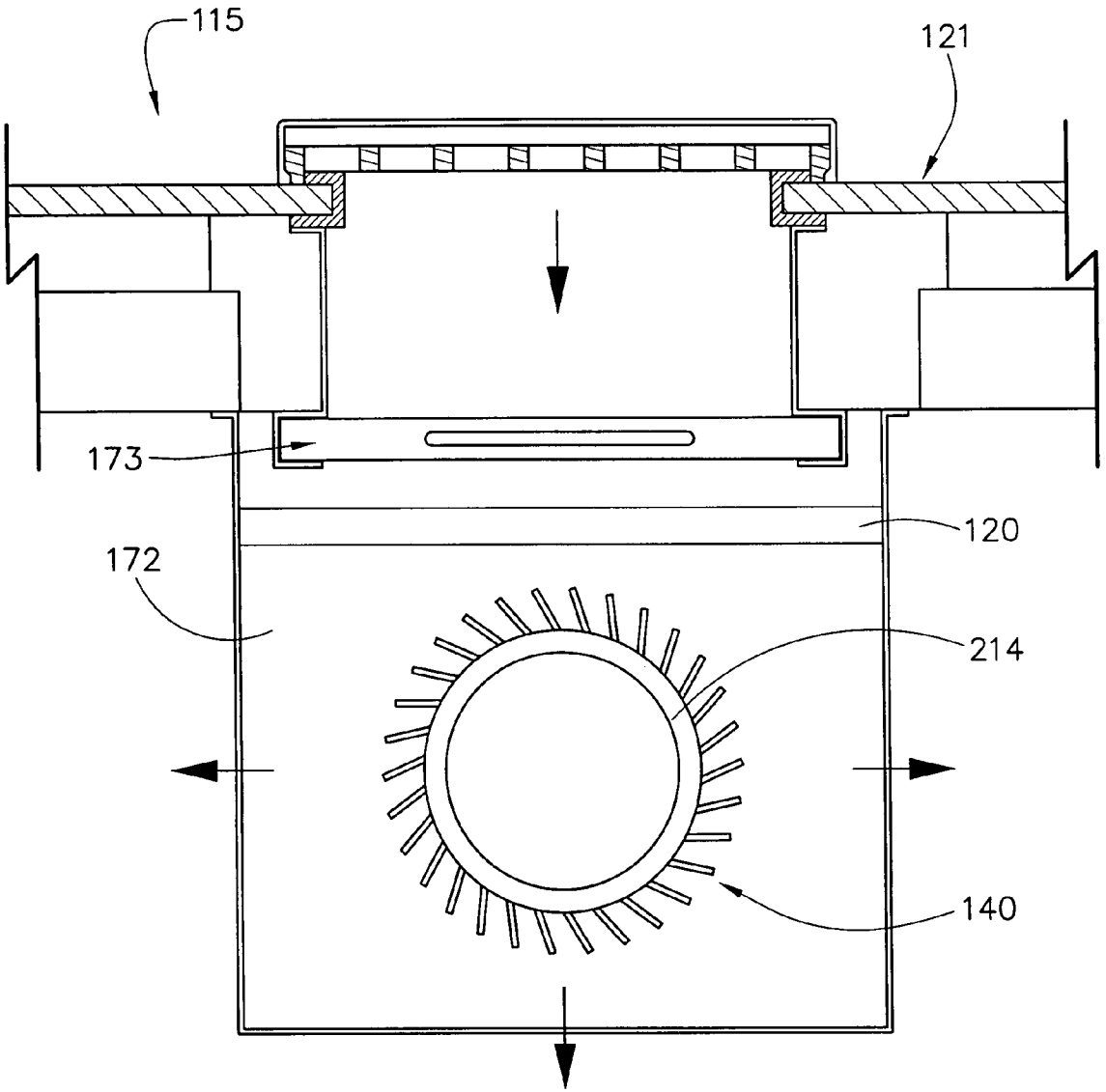
FIG. 6 illustrates a cutaway front view of still another embodiment of the present invention.

FIG. 6 shows yet another embodiment of the current invention. This embodiment includes a filter assembly 173 which is contained in the inner cavity 172 of the appliance 115 below the cook top 121. Below the filter assembly 173 and filter, is preferably a heat exchanger 120 which provides for cooling of the effluent and heated air as it passes through the air filter and down into the inner cavity toward the blower assembly 140. In this embodiment, the blower assembly preferably includes a cross flow blower 214 with a wheel fan.

Figure 7A:
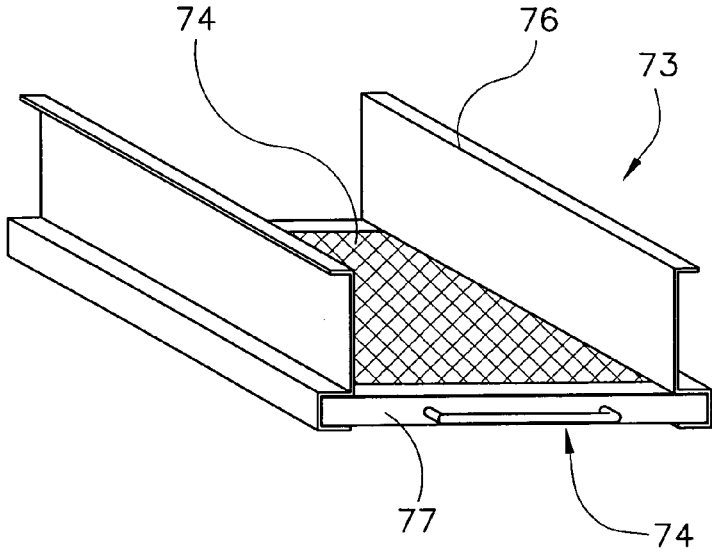
FIGS. 7A-B illustrate enlarged perspective views of various embodiments of a filter of the present invention.
Figure 7B:
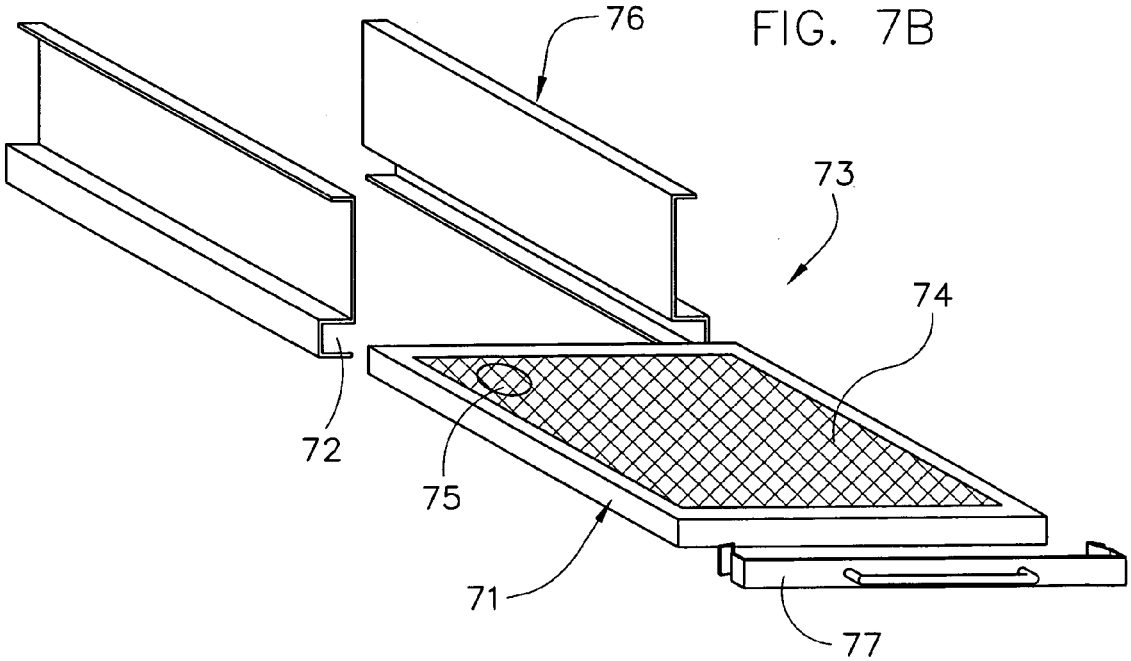

FIGS. 7A and 7B show a filter assembly 73. The filter assembly includes a filter tray 71 which fits into a tray slot 72. The filter tray includes a filter 74 and an air flow sensor 75. The filter tray 71 has a filter tray handle 77 which may be removed when the filter 74 is ready to be discarded. The filter assembly preferably forms a filter tray drawer 76 which can slide in and out of the inner cavity 172 of the appliance 115 as best illustrated by FIG. 6.

Figure 8:
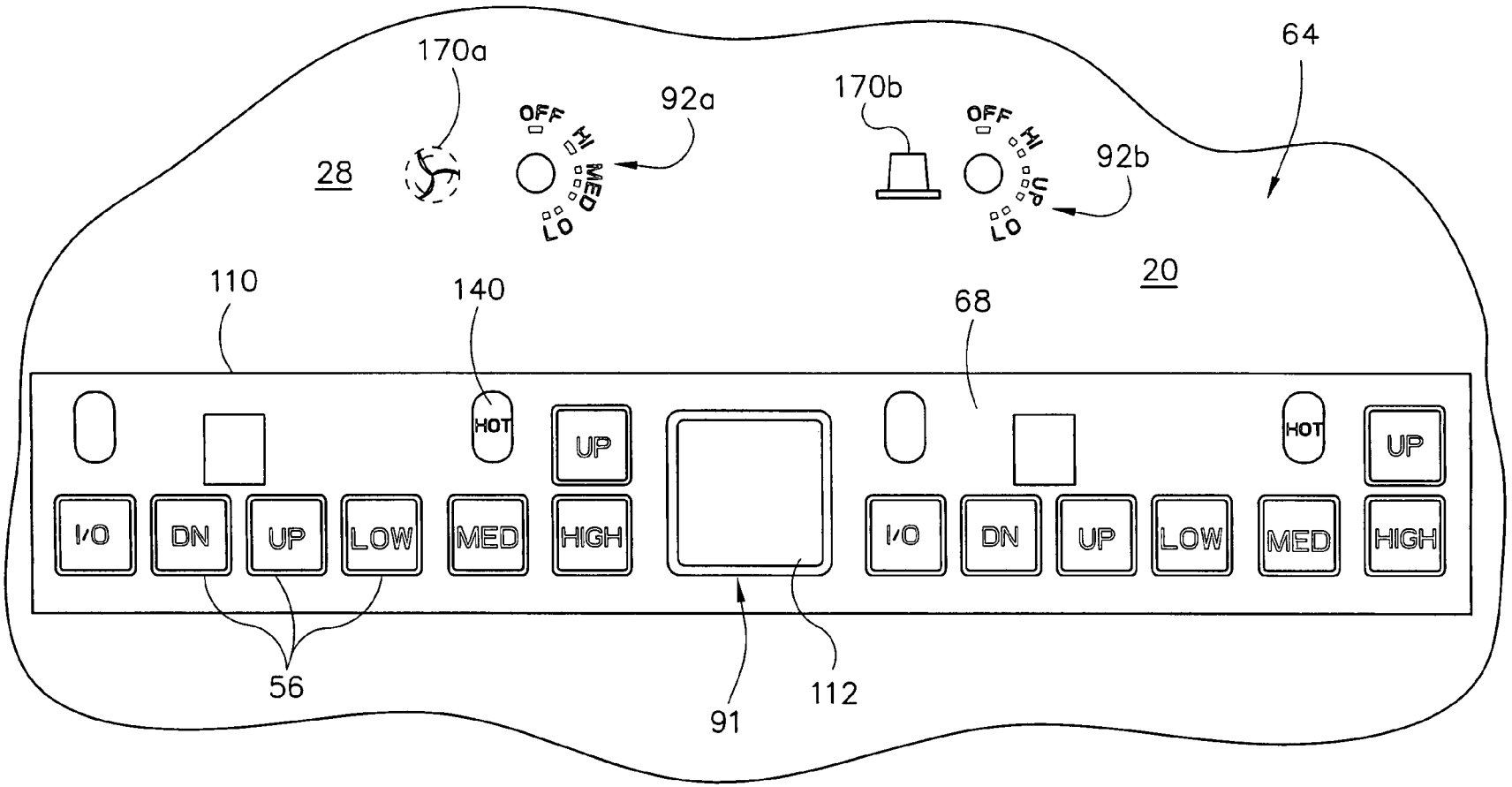
FIG. 8 illustrates a top view of controls of yet another embodiment of the present invention.
Figure 13:
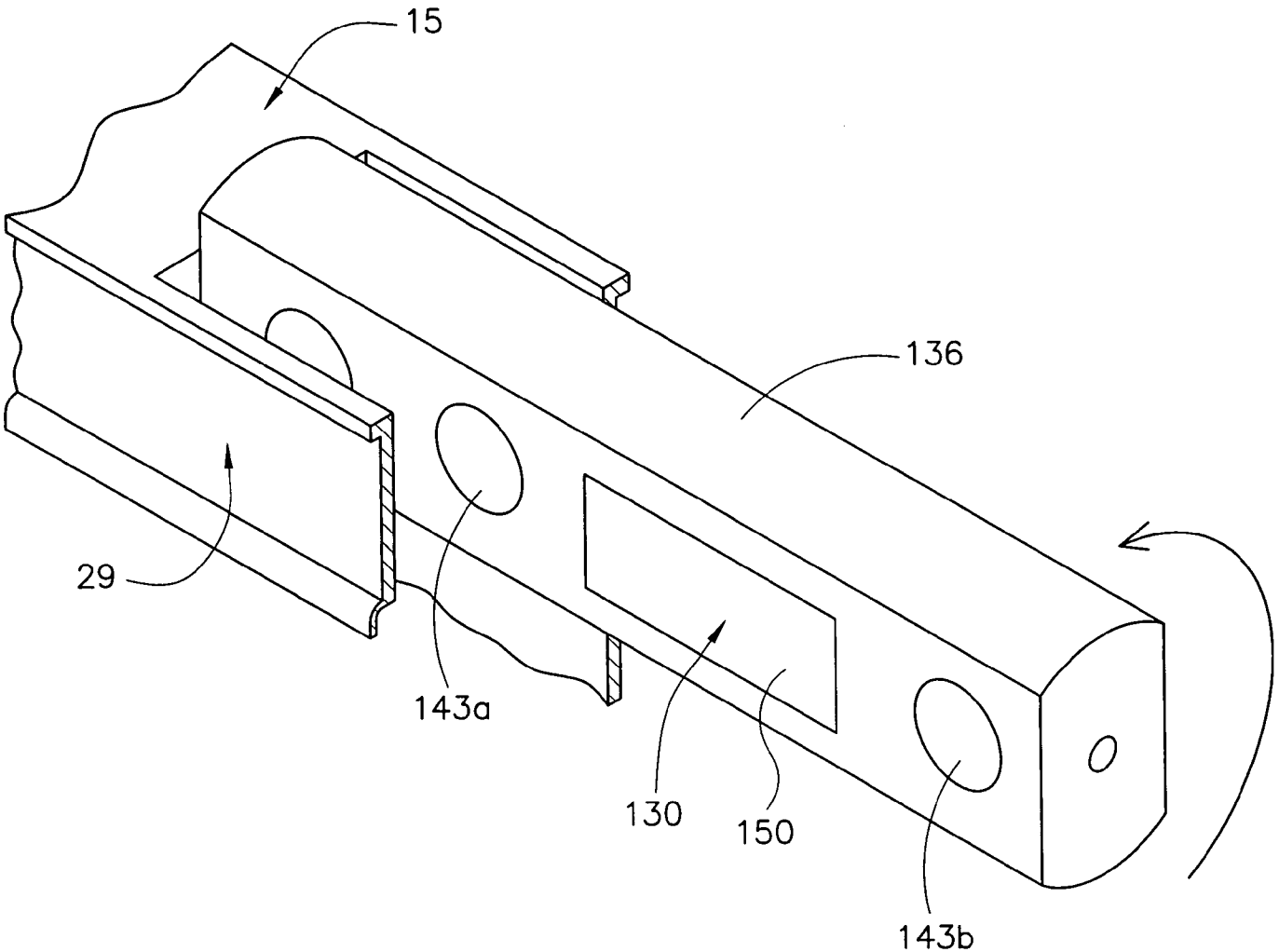
FIG. 13 illustrates an enlarged broken away view of a display of one embodiment of the present invention.

FIG. 8 shows another embodiment of the present invention. In this embodiment, a broken-away section of the cook top 20 is shown. In this embodiment, on the cooking surface 28 is preferably mounted a series of controls. These controls include touch devices 56 which are part of preferably a keypad 110. The keypad 110 may be integrated into a control panel assembly 64 which may include another touch control panel 68. A display device 91 may also be present. The display device 91 acts as a display interface 112 to interface with the user. Also on the cooking surface may be other controls such as selection switches 92*a* to control the fan speed, and 92*b* to control the height of the telescoping ventilator. Graphics such as a fan 170*a* and a telescoping ventilator 170*b* are used to indicate the type of controls. As can be seen at FIG. 8, the controls can act as on/off switches, high/low switches, up/down switches, and high/medium/low switches. On the panel may also be an indicator light to indicate that the surface is hot. Such an indicator light may be an LED display 140.

As mentioned, a filter or catch 74 is preferably used for removal of effluents. The filter 74 may use carbon for removing odors, particulates, greases and oils, and moisture that condensates on the median. Additional filters may also be included. A metal mesh filter also may be used as well as a louver type filter. A combination of these filters with a charcoal element may also be used in this application. In a preferred embodiment, the filters are angled to drain fluids off and collect them into a grease trap. A grease trap or trough is also preferably provided. These troughs are removable for ease of cleaning.

The sheet metal/material construction of the appliance's back housing 29 may also accommodate a lighting system as mentioned above. This design allows any type lamp holder to be installed in a convenient way. For example, in one embodiment, by twisting a male connector to the female connection, a fixture is locked in place. The female connection can be designed into the housing providing a fixed point.

Alternatively, lighting may come from ventilator and provide lighting at different angles. Lighting provided may also be on a bendable, moveable arm, e.g., a snake light system.

In one preferred embodiment, housed within the ventilator's outer frame of metal/plastic or other material is an opening to provide the viewing of an electronic display. The electronic display may also include the control board electronics. The controller is preferably an electronic board attached by bolts and nuts, but could be held in place by other methods like adhesive, tape, connector, etc. The wiring for the control panel preferably is shielded from being seen and being contaminated by dirt that may coat the wires.

As mentioned, the appliance 15 of the present invention preferably has at least, e.g., one sensor 90. The sensor may form part of a sensor system that includes one or more of the following: a pot detector system, an IR detector system for heat, smoke, fire and/or distance, humidity, a gas (e.g., hydrocarbons, CO, CO2) detector, a pressure sensor, moisture or steam sensor, temperature or thermal sensing technology such as RTDs (resistance temperature detectors), integrated circuit sensors (IC), thermistors, IR thermometers, bimetallic, and thermocouples. Other sensors may include: any electronic AC or DC sensor used for detecting movement, UV reflectance, resistance, flow, item detection, noise, power or other sensor for the detection and control of the ventilator blower with electronics. Also, a sensor may be used for detection and control of speed for both the fan/blower and the drive mechanism. Sensors for the detection of the temperature are preferably located on the cooking surface 28, back housing 29, or ventilator 30. Other sensors are directed for the sensing of the items placed on the cook top or the range. The sensors are preferably connected to control board 98 via wires or a wireless connection. Finally, an air flow sensor may be provided to detect the flow of air past the filter(s) (See, e.g., FIGS. 7A-B, sensor 75). This feature preferably measures the air flow and indicates to user the need for filter replacement or cleaning due to restricted air flow.

Of course, any IR/thermometer that can measure objects that move, rotate, or vibrate (e.g., web process or any moving process) may be used in addition to the ones mentioned above. Such IR sensors are useful as they do not damage or contaminate the surface of the object of interest and they measure the temperature of the actual product being used on a cook top or range and not some of the other parts of the surfaces. Further, the thermal conductivity of the object being measured such as glass, metal, wood, or even very thin objects does not present a problem, as with other sensors. Response time of these sensors is in the millisecond range, which gives the user more information per time period. Any other electronic IR sensor used for detecting temperature, resistance, heat/fire, distance, moisture/steam, or power for detection and control of the ventilator blower with electronics may also be used.

Two types of ventilators may be used with the present invention, ducted and non-ducted. In a ducted type ventilator, there is a duct that is used for venting air to the outside. See, e.g., FIG. 2. This duct can be attached at the top, back, or directed downward to the floor in a room, or have a chimney cover the duct at the top.

In a non-ducted type ventilator, there is no duct that is used for venting air to the outside. See, e.g., FIGS. 3 and 6. This non-duct unit can be vented at the top, side, back, front, and/or directed downward to the floor in a room.

As mentioned, a cross flow fan/blower assembly preferably provides the drawing force needed to pull contaminated air into the ventilator. The assembly is preferably composed of a housing mounted to the appliance. Attached to the housing is the drive motor. A wheel assembly contains the bearings, hub, and a wheel of either the skewed or straight bladed type. A fastener preferably connects the wheel assembly to the motor.

Multiple burner specific blowers and ventilators may be used to divide the cooking surface 28 into zones that provide air flow control within the zone. An air curtain may be created at the perimeter to preferably enclose these zones. Blower motor speed in the zone may be reduced with the improved efficiency and thus the noise level may be decreased. This greatly increases the overall efficiency of venting. Moreover, the energy saved from not having to turn on and run another large blower motor provides added benefits to the user in the way of cost saving. An added benefit is a lower ventilator profile due to the more efficient, smaller motor(s)/blower(s) assembly. This gives a person more room for viewing and working under a ventilator, or a larger cabinet below the ventilator to provide more user space. The fan/blower may also be used for ducting heated air or moisture out.

Another aspect of this design is the ability for the fan to be controlled by a humidity sensor, CO, or CO2 sensor, and/or hydrocarbon detectors. (See, e.g., FIG. 1, sensor 90). Greater versatility may be had with the use of electronics and the different types exhaust elements. These innovations control the power load for the exhaust vent and only supply that amount of power needed to effectively operate the ventilator. Electronics or electromechanical controls may also prevent the spread of fire through regulating electricity flow, blower speed, and heat.

As mentioned, the ventilator preferably includes a tangential or cross flow fan/blower that uses an AC or DC drive motor(s). The cross flow blower(s) may use tangential wheels and skewed fan blades, straight blades or other blade designs for the moving of air. Alternatively, a long length axial or centrifugal fan/blower assembly wheel may be used. The fan may be of a fixed or a variable speed with nearly infinite speed setting. As mentioned, the blower is preferably located as close to each of the burners as possible. With two or more blowers, different size blowers may be used with different cubic feet per minute ratings (CFM). This provides greater effluent removal where needed. If large burner elements are located at the front of a range, the invention provides the ability to use a large cross blower (CFM) near those burners to remove the contaminated air. Each fan can be used as a power exhaust vent for removing air, or mixing fresh air with return air, and/or management of moisture/heat buildup. Fan operations may be controlled by a sensor, detector, or switch. Such individualized features allow the ventilator to detect the air flow draw needs for each burner and also the amount of draw needed. As the blower draws air downward, it eliminates hot spots or stratified layers of varying temperatures on a range's cook top. Alternatively, the fan/blower(s) may be remotely located from the ventilator or built on/in with duct work while still providing individual air removal near a burner. These ducts can be closed off to each location and opened when selected by a user or system.

As shown in FIG. 8, unit 15 may have a panel 64 with, for example, a display 91 that shows the user, e.g., fan speed levels. This can be used to assist in finding proper speeds and heights, which then can be programmed into an electronic control board for repeated operations later. Further, the panel 64 has the ability to show to the operator, e.g., types of operations, functions, filter life/change, and times using electronics and to accurately control these operations to remove contaminated air. Such a panel 64 may also be used to control movement and operation of the ventilator 30. Construction of the electronics includes: high heat construction design; specialized adhesive construction; loop resistant circuitry; ESD/EMI/RFI shielding; and LED, LCD, plasma, dot matrix, vacuum fluorescent display(s). All of these can improve the control, display, design, look, and operation of the electronic (s). Electronic touch control panel(s) could use a piezo touch panel (keypad) for selection of operations by operator. In some instances, the controls are sufficiently isolated in other ways to prevent appliance temperatures from damaging the control.

As mentioned, the panel 64 may include an electronic touch controller 68, e.g., a keypad that may be made of glass, metal or plastic, with selection of the operating function(s) made by touching the surface of the glass, metal, or plastic. For the ventilator, a resistance type touch control keypad may be used whereby touching plastic, metal, or glass at a location, e.g., on top of the ventilator, causes a change in an electrical signal. The piezo, capacitance, resistance, inductive and tactile membrane switches used may be fitted with decorative overlays, under lays, labels, trim and completed control panel assemblies. Touch control key pads/panels may be installed flush, raised, or recessed. It should be noted that the touch control key pads/panels may be installed in nearly any plane and on any surface. For example, touch controls keypads and displays may be placed on the front or top of the cooking surface 28 to provide the operator with instant viewing of the operations and functions. A remote control 62 may be added by wire or by wireless controls, see, e.g., FIG. 5.

As mentioned, the electronics provided allow for programmable/selectable set points, programmable/selectable set times, and programmable/selectable set operations as well as set times for both on and off or changes in functions, set points, speed, or functions. The ability to select multiple functions, operations, and times gives the inventive appliance advantages over non-electronic controlled units. This programmability/selectability provides the advantage of being able to enter different functions or operations into the electronic controls and have the system respond. Further, an electronic control permits more user freedom.

Another aspect of the present invention is a multi-function display. For example, a clock may be on the electronic(s) display when not in use or when in use. See, e.g., item 112 in FIG. 8. It may also be changed to permit other programmable information to be displayed, such as, messages or computer information. This area may also have an LED night light included in the electronics such that the LED would come on when the room is dark. The use of an LED or a bulb of this type can save energy and space.

Another aspect of this invention is the ability to have "no switch" controls. Here, for example, the cook top backing 29 acts as the switch. For example, a user may touch the trim top surface in the front, top, or sides and this would operate the ventilator by moving it and turning on the blower. Alternatively, a user may touch the ventilator a number of times to move it up or down or to speed up or slow down the fan. The user may also touch the ventilator and hold for a longer time to which the blower would turn off or on. The user may turn a light on in the same manner.

The appliance 15 may also be equipped with a sound- or voice-activated system that in one embodiment lets the user speak to the appliance and state what controls and operations the user wants. This provides the user the ability to operate hands free, therefore, allowing the users to do something else with their hands. Alternatively, the appliance can be hooked up to a PC computer or a whole house computer system for operation and control.

Another aspect of this invention is an appliance 15 designed with a temperature control or cooling element 120. See, e.g., FIG. 6. The element 120 is preferably secured to the inside of cavity 34 or remotely. In this one embodiment, heated air is circulated through the ventilator 30 and past the element 120 to provide better heat control to the non-ducted ventilator both inside the appliance and inside the cooking room. The fan or blower assembly 40 provides air movement inside cavity. This system cools/heats the exhaust air before delivery of air to the room. Preferably, such a system is included with a non-ducted unit. These cooling systems are sometimes referred to as a "heat pump." Thus, such a heat pump may be used to make the ventilator not only a venting unit, but a cooling/heating unit. This feature is important, for example, when larger ventilators are designed to recycle air back into the room. With the use of larger cook ranges, a large amount of heat is generated and returning this heated air to the room can be a big issue for the user. Here, the cooling/heating system is used for extracting effluents (like steam) and cooling of the drawn air to a proper temperature for return. The system may also include a device to select a precise return air temperature. For example, with the ability to cool and treat the exhaust air, this feature provides the user the ability to select the temperature of the returning treated air to the room, e.g. 70 degrees Fahrenheit. Humidity buildup in the cavity chamber may also be controlled by a power venting or condensation drainage system. The system may include an electric chill or a refrigerant such as that found in freezers, a circulating system to provide removal of heat, or an electric cooling heat exchanger.

As mentioned, the vent 30 may have a vent cover 31 that includes: louvers, holes, or slotted opening(s) for exhausting treated air. These may be closed off by a motor-driven vent slide, bimetal device, solenoid, electromagnetic, or other electronically or electro-mechanically controlled shut off device 33. FIGS. 9-12 show a few of the embodiments of this feature. For example, FIG. 11 shows an embodiment with gear teeth on it. Preferably, it is in contact with a stepper motor/AC motor/DC motor that controls the opening. Other devices that deliver motion, such as linear motion devices, wax motors, etc., may be used. The cover regulates the flow of air being exhausted or brought in. The vent cover may be fully opened or closed (sealed cavity), or opened to a varying degree to control heat or moisture buildup. When used with a forced air (powered) re-circulating system, even greater control can be had. The damper or slide system allows for flows to be proportional thus controlling air movement and contaminated air for cleaning. Even though FIG. 1 shows the slots on the top of the ventilator, vents can be at the side, front, and at the back, or in or at any location on the ventilator. The vents may also be closed in the event of a fire on the range.

In accordance with another aspect of this invention, the ventilator may be controlled by electronics and equipped with an AC or DC electronic temperature sensor, e.g., sensor 93*a*, 93*b*, 93*c*, and 93*d* located on the ventilator, cook top, or elsewhere such that the temperature of the ventilator can be detected accurately. See FIGS. 1-5. Such controls provide control and operation response to sense temperature on the range or in the ventilator and then turn the exhausting functions on/off and adjust speed according to needs. Any electronic sensor used for detecting heat/temperature, CO, CO2, hydrocarbons, or power, for example, thermal detection devices may be used to control the exhaust. In one embodiment, the blower exhaust motors are electronically connected to a temperature-sensing device and is DC powered in accordance with requirements for the unit. Here the motor/blower is also protected in the event of a fire by an automatic turn off. The user may also select settings or preset settings for the electronic control(s) to maintain the desired exhaust flow within the vent's chamber. The sensing device maintains performance in a predetermined desired range of operating temperature(s) or set point(s). A sensor may also be mounted on an electronic board or it can be attached by itself to any wall or location from which detection of the board's temperature can be made.

RTDs may be used to provide the appliance low cost over other methods when used with electronics. Even though RTD sensors tend to be relatively slower in response than thermocouples, which are used in many ventilators today, RTDs offer several advantages well know to those of ordinary skill in the art.

For example, one method for a sensor circuit uses a RTD temperature sensitive element to measure temperature from ambient to elevated temperatures. One of ordinary skill in the art is familiar with such sensor circuits, so the circuit is not shown. The information from the sensor circuit can be also displayed and/or processed for control of the motor, blower, and speeds. All of the above information can be made on a chip. This chip can be placed in an ideal area for detection of temperature. This circuitry preferably provides data/information to the control board for controlling functions of the ventilator. Alternatively, distributed temperature may be used to sense temperature at every point along an SS sheathed fiber and feature a resolution of 0.5 degree C. and a spatial resolution of 1.5 m. The fiber can range up to 2,000 m and can be coiled at specific points of interest. The fiber can be sheathed with a nonconductive polymer for intrinsic applications. This method provides the ability to profile a range/cook top for detection of temperatures at many points. The strip may be along the complete front of a ventilator trim at the edge. Response times are thus reduced and provide the control board the ability to sense the complete top of a target zone rather than just one zone. This also provides the manufacturers the ability to customize the zones placing more points in areas for detection. The use of electronics and sealed components allow theses systems to be used outdoors also.

Next generation fiber optic distributed temperature sensors (DTS) may be used as part of the present invention to sense temperature at every point along an SS sheathed fiber. These feature a resolution of 0.5 degree C. and a spatial resolution of 1.5 m. The fiber may range up to 2,000 m and can be coiled at specific points of interest. The fiber may be sheathed with a nonconductive polymer for intrinsic applications. With this system, many locations for detection are provided. Response times are shorter and sensing of the complete top of a target zone rather than the one zone may occur. This also provides the manufacturers the ability to customize the zones by placing more points in areas for better detection.

As mentioned, another aspect of the present invention is to have nearly infinite fan speed adjustment levels. This can be done, for example, by having the user touch down on a glass resistance keypad until the speed required is reached. Once the speed is reached, the electronic control may reduce or completely cut off current/power to the blower(s)/fan(s). The keypad may have one or more keypad location(s) for operating the increase or decrease/on or off of the speed by the user. For example, three locations for independent operations can provide the user with better control. A display may show the user the speed level and may be used to assist in finding proper speeds, which then can be programmed in to the electronic control circuit for repeated operations later. Alternatively, the sensor 93*c* for controlling the fan 44 may be connected to fan regulator 48 as shown in FIG. 3.

As discussed, the appliance of this invention is designed for outdoor locations as well as indoor ones. The appliance design has the ability to weather outdoor temperatures and environment. For example, the use of electronics for appliance provides better sealing for these environments. Further, remote electronic controls 62 not only provide convenient remote operations for use outdoors, but also reduce the effects for some of the environment on the controls. Further, electronics are not subject to the mechanical problems of turning in extreme weather conditions. They are also resistant to other environmental conditions.

As previously mentioned above, the ventilator of the present invention is very versatile. For example, it may be built into/on a mobile island or cart; such as for use with grilling/cooking equipment. Alternatively, the ventilator itself may be a separate mobile unit, e.g., a frame that is self-supporting or free-standing. Such a mobile ventilator may be, e.g., mounted on wheels and does not need to be installed into a cabinet or other unit to add structural support.

FIG. 5 shows a remote sensing and receiving system which includes a sensors and/or a remote receiver 107 along with remote control panel 62 at a different location. Here, the sensor preferably includes a transducer to sense a physical parameter on the cook top of range. The transducer will generate an electrical signal representative of the physical parameter and apply the data to a processor. In response, the processor drives a digital display, which produces visual indications of these parameters. The processor provides communication between the sensor(s) and the remote receiver which drives some operations by the ventilator. For example, the receiving unit 62 controls the ventilator from signals for turning on, to adjusting the speed of the blowers. The sensor(s) and receiver(s) may both have a transmitter and receiver to enable communication through signals. This would be helpful when changing set points or detection points.

In one embodiment, the remote sensing and receiving system or detecting and display system is configured as a remote keypad. For example, the keypad apparatus preferably includes a display and a remote transducer unit having a temperature sensor unit or other transducer exposed to the cook top/range.

As discussed, physical parameters measured by remote sensing and receiving system are not limited to temperature. For example, a sensor/transducer may be used in extinguisher devices in which the quality of the air from a range is measured for CO, CO2 or other gasses for fire fighting. Note: Transducer Technology, Inc offers a T series carbon monoxide sensor using nano—particulate technology for sensing or an amperometric electrochemical sensor. In this embodiment, if a fire develops, the remote sensor and remote control devices can activate a fire extinguisher. Here, a microprocessor preferably controls the various circuits associated with this system. Various other devices may be coupled to such a microprocessor to control other functions within the appliance.

In another embodiment, a fire protection system may be included. See, e.g. FIG. 5, system 105. The fire protection system 105 preferably has a warning device and a built-in fire extinguisher. The fire detection system preferably also turns off the blower and other electronics and closes at least one vent through a control board. This feature prevents the spread of fire in and around the appliance. Further, critical temperature levels may be set by the factory so that when the sensors detect these present levels, the ventilator activates the fire protection system.

Another feature of the present invention is preferably the use of an output device or display 130 located, for example, on a sliding panel, a rotating panel, or popup panel attached to the backing 29 of the appliance 15. See FIG. 13. In the rotating display shown, the display panel or screen is an LCD display 150. Input buttons 143*a*, 143*b* may also be present. This ability to conceal the display 130 protects it from damage and provides a smooth looking surface. In one embodiment, this is accomplished by placing an electronic display on a rotating drum, a rotating L-shaped plate, or on a triangle-shaped part. Once the operations are complete, the user of the appliance 15 can rotate the display 136. In one embodiment, the user can touch the front of the display 136 to activate movement. Once the electronics sense the pressure on the display 136, the rotation begins until it reaches the stop point. In this case, the stop point would be when the unit provides the smooth surface. The other way the display 136 may move to a closed position is if the display 130 and the ventilator have been off for a time. Once that time has been reached, the display 136 returns back to the closed position. A motor or some other means of rotating the display 136 may be used to provide movement. Switches, stepper motors, or magnetism can be used for the location of stop points.

Figure 14:
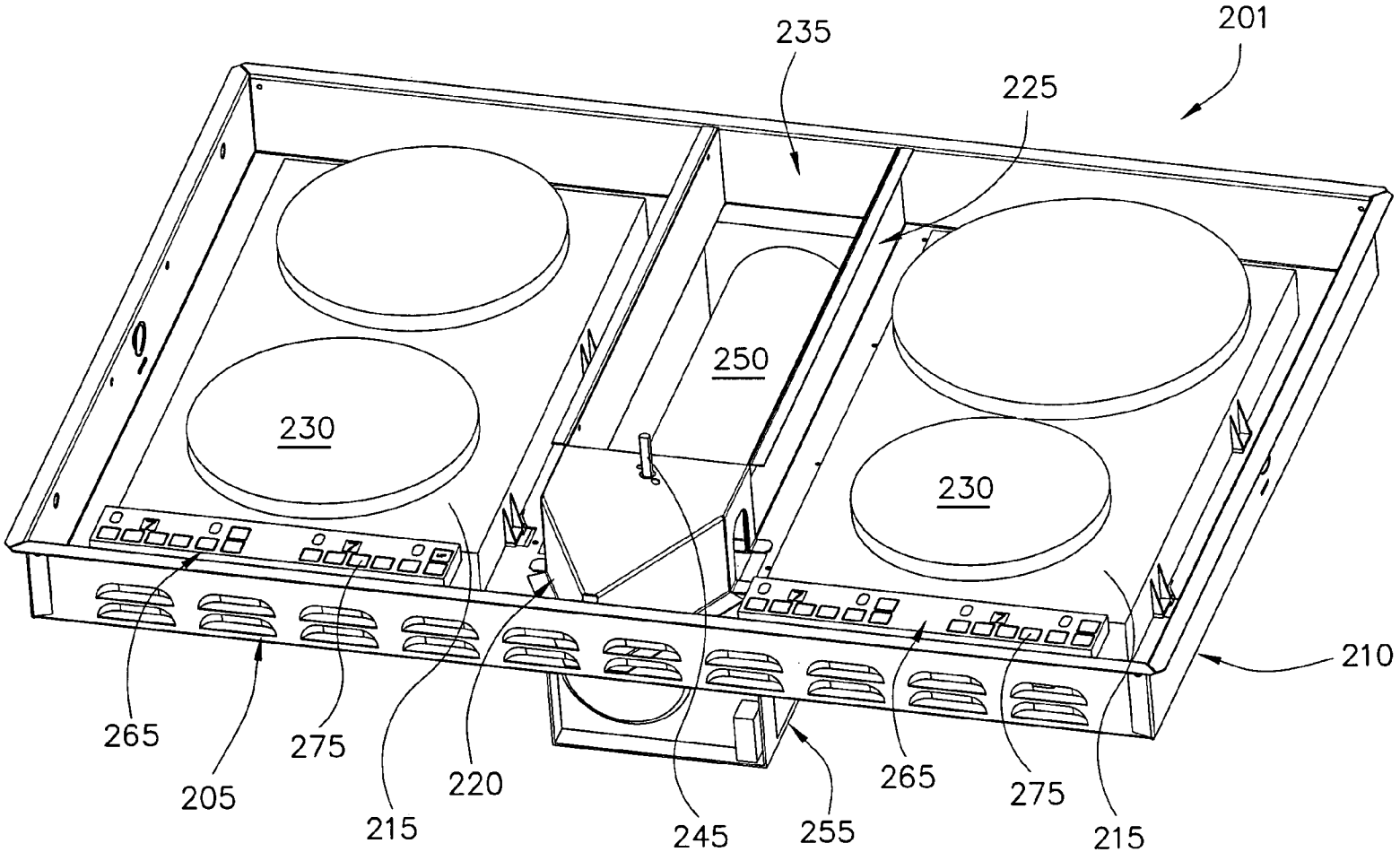
FIG. 14 illustrates a perspective view of yet another embodiment of the present invention with the glass top removed for clarity.

In one preferred embodiment shown in FIG. 14, louvers 205 may be added to the front of the cook top 210 of appliance 201 to draw air straight into an induction hob box 215. Further, a triangular shaped member 220 could be added to the ventilator box 225 to taper it to a point in the front, yet still draw a large amount of air without necessarily interfering with airflow to and from the induction hob element 230. In this way, for example, the volume of air stays the same, but the velocity increases so as to give better cooling across the surface and from the hobs. Thus, such a V-shape is preferred because it essentially acts as a restriction point to increase airflow top the hob units. The ventilator downdraft assembly 235 in this embodiment is preferably sealed off completely from this hob cooling system. A shaft 245 for the controls of a ventilator fan is also shown as is a tube fan housing 250 of the downdraft blower assembly 255. The burner element controls 265 are shown here as touch pad controls 275.

In another embodiment, one or more displays may be used to interface with the operator the functions, temperatures, speeds, need for a filter change, and time. For example, the controller may have a graphic specific to the design and function of at least one of the blower assembly (e.g., a small fan picture), lighting, and the ventilator (e.g., ventilator graphic) as shown in FIG. 8. Again, such controls are preferably mounted on at least one of: a top, face, side, or other surface of the ventilator or cooking surface for easy viewing and use.

There are virtually innumerable uses for the present invention, all of which need not be detailed here. For example, the cook top disclosed herein may be used in a side-to-side, back-to-back, or other configuration for serving as part of a larger, expandable cooking area. Of course, this and all of the other disclosed embodiments can be practiced without undue experimentation.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. In addition, the individual components need not be fabricated from the disclosed materials, but could be fabricated from virtually any suitable materials. For example, construction materials for the cook top, the downdraft, and blower are at least one of: metal, glass, stone, a transparent material, tile, plastic, and manmade material. Moreover, the individual components need not be formed in the disclosed shapes, or assembled in the disclosed configuration, but could be provided in virtually any shape, and assembled in virtually any configuration. Further, although various components as described herein as physically separate modules, it will be manifest that they may be integrated into the apparatus with which they are associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A cook top comprising:

a housing having a unitary body;

an induction heating element surrounded by and affixed to the housing to form an integrated structure with the housing;

a passage bound by the housing, the passage having an outlet, a first inlet positioned on a side of the induction heating element opposite the outlet, and a second inlet separate from the first inlet and fluidly connected to a cooking area located above the induction heating element;

a blower fluidly connected to a plenum and aligned with the outlet of the passage; and a vent fluidly connecting to the plenum such that operation of the blower draws air through the unitary body of the housing and removes effluent from the cooking area and provides a cooling flow across the induction heating element.

2. The cook top of claim 1, further comprising a glass cooking surface attached to the housing such that the glass cooking surface does not interfere with either of the first or second inlets.

3. The cook top of claim 2, further comprising a drive system for retractably extending the plenum above the cooking area.

4. The cook top of claim 1, further comprising a filter located in the channel such that the filter traverses the passage between the second inlet and the outlet.

5. The cook top of claim 1, wherein the blower includes at least one of: a system that manages air and effluent from the cook top and cooling air from the induction heating element, a regulator for electrical current to a blower motor such that power output can be changed as needed, a tangential fan to circulate air downward, a cross flow fan, a centrifugal fan, a fan that can be remotely located in attached duct work, a fixed speed fan, a variable speed fan to control air movement, a squirrel cage wheel fan, a fan with adjustable speeds that may be preset, a fan used as a power vent for removing air, a re-circulating system, a mechanism for sucking air from the cook top, a fan for management of heat build up and controlled by a heat sensor, a large chamber plenum assembly, and a fan to move air through a heat exchanger.

6. The cook top of claim 1, wherein the induction heating element is one of a first pair of induction heating elements that are surrounded by and affixed to the housing to form an integrated unit with the housing, and further comprising a second pair of induction heating elements that are surrounded by and affixed to the housing to form the integrated unit.

7. The cook top of claim 1, wherein the first inlet includes a first portion positioned outboard of a first pair of heating elements and a second portion positioned outboard of a second pair of heating elements.

8. The cook top of claim 7, wherein the first portion and the second portion of the first inlet are oriented generally perpendicular to the second inlet and the outlet of the passage.

9. The cook top of claim 1, further comprising a plenum that slidably passes through a cooking area.

10. A cook top comprising:

a housing having a unitary body;

an induction heating element surrounded by and affixed to the housing to form an integrated structure with the housing;

a passage bound by the housing, the passage having an outlet, a first inlet positioned on a side of the induction heating element opposite the outlet, and a second inlet separate from the first inlet and fluidly connected to a cooking area located above the induction heating element;

a blower fluidly connected to a plenum and aligned with the outlet of the passage; and a vent fluidly connecting to the plenum such that operation of the blower draws air through the unitary body of the housing and removes effluent from the cooking area and provides a cooling flow across the induction heating element, wherein the induction heating element is one of a first pair of induction heating elements that are surrounded by and affixed to the housing to form an integrated units with the housing, and further comprising a second pair of induction heating elements that are surrounded by and affixed to the housing to form the integrated unit, the outlet of the passage extending generally laterally between the pairs of heating elements.

11. The cook top of claim 10, wherein the first inlet includes a first portion positioned outboard of the first pair of heating elements and a second position positioned outboard of the second pair of heating elements.

12. The cook top of claim 11, wherein the first portion and the second portion of the first inlet are oriented generally perpendicular to second inlet and the outlet of the passage.

13. The cook top of claim 10, further comprising a glass cooking surface attached to the housing such that the glass cooking surface does not interfere with either of the first or second inlets.

14. The cook top of claim 10, further comprising a drive system for retractably extending the plenum above the cooking area.

15. The cook top of claim 10, further comprising a filter located in the channel such that the filter traverses the passage between the second inlet and the outlet.

16. A cook top comprising:

at least one induction heating element having a cooking surface located thereabove;

a cook top vent for removing at least one of air and effluent from the cook top to a lower cavity; and a blower assembly in fluid communication with the vent, wherein the blower assembly includes;

a system that manages at least of the air and effluent from the cook top and cooling air from the induction heating element, a regulator for electrical current to a blower motor such that power output can be changed as needed, a fan that circulates air downward from the cooking surface and that is controlled to at least one of: reduce moisture build up on the cook top under control of a humidity sensor and reduce heat build up on the cook top under control a heat sensor, and a plenum assembly coupling the vent to the fan.

17. The cook top of claim 16 wherein the induction heating element is one of a first pair of induction heating elements that are surrounded by and affixed to the housing, and further comprising a second pair of induction heating elements that are surrounded by and affixed to the housing and an outlet of a passage extending generally laterally between the pairs of heating elements.

18. The cook top of claim 16 further comprising:

a base and wherein the at least one induction heating element is a first induction heating element affixed to the base;

a second induction heating element affixed to the base;

a cooking surface affixed to the base generally above the first and second induction heating elements; and wherein the plenum assembly includes a ventilation passage communicating air from a cavity containing the induction heating elements.

19. The cook top of claim 18, further comprising the cooking surface is generally continuous and includes an opening cooperating with the ventilation passage.

20. The cook top of claim 16 wherein the blower assembly is contained within a box that contains the induction heating element.

* * * * *